US006564706B1

(12) United States Patent
Morita et al.

(10) Patent No.: US 6,564,706 B1
(45) Date of Patent: May 20, 2003

(54) STENCIL PRINTING MACHINE, STENCIL DISCHARGE APPARATUS AND STENCIL PRINTING SYSTEM

(75) Inventors: Naoki Morita, Ibaraki-ken (JP); Makoto Miyaki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/410,632

(22) Filed: Oct. 4, 1999

(30) Foreign Application Priority Data

Oct. 6, 1998 (JP) ..... 10-284250
Aug. 30, 1999 (JP) ..... 11-243591

(51) Int. Cl.[7] ..... B41L 13/00
(52) U.S. Cl. ..... 101/114; 101/116
(58) Field of Search ..... 101/114, 129, 101/120, 116, 483; 100/49–52, 99

(56) References Cited

U.S. PATENT DOCUMENTS 3,855,919 A 12/1974 Potter ..... 100/52
4,201,128 A * 5/1980 Whitehead et al. ..... 100/45
4,846,057 A * 7/1989 Endo et al. ..... 101/120
5,074,204 A 12/1991 Hasegawa et al. ..... 100/49
5,090,310 A * 2/1992 Motoe ..... 101/114
5,323,706 A * 6/1994 Sugawara ..... 101/114
5,463,951 A * 11/1995 Waizmann et al. ..... 101/423
5,579,684 A * 12/1996 Stribling ..... 100/48
5,632,200 A * 5/1997 Fukai ..... 101/114
5,680,818 A * 10/1997 Tomiki et al. ..... 101/425
5,713,274 A * 2/1998 Kawai et al. ..... 101/114
5,967,028 A * 10/1999 Schomisch et al. ..... 100/35
6,067,901 A * 5/2000 Takahashi ..... 101/114
6,276,275 B1 * 8/2001 Schafer ..... 101/483

FOREIGN PATENT DOCUMENTS

EP 0 689 938 1/1996
EP 0 699 541 3/1996

* cited by examiner

*Primary Examiner*—Anthony H. Nguyen
(74) *Attorney, Agent, or Firm*—Kanesaka & Takeuchi

(57) ABSTRACT

A stencil discharge apparatus for a stencil printing machine has a discharge box for storing a predetermined amount of stencil sheets after being peeled off from a printing drum so as to discharge the stencil sheets. The stencil discharge apparatus includes a compressing device for compressing the stencil sheets discharged into the discharge box through motion of a compressing plate; a compressing pressure sensing device for sensing and outputting a compressing pressure of the compressing means; a moving amount sensing means for sensing and outputting an amount of motion of the compressing plate; and a control device for calculating a storing amount of the stencil sheets in the discharge box on the basis of sensing a predetermined pressure through the compressing pressure sensing device and an amount of motion sensed by the moving amount sensing device.

15 Claims, 19 Drawing Sheets

WARNING GENERATING PROCESS AT THE STENCIL PRINTING MACHINE

STENCIL PRINTING MACHINE, STENCIL DISCHARGE APPARATUS AND STENCIL PRINTING SYSTEM

BACKGROUND OF THE INVENTION

1. Field of the Invention

This invention relates to a stencil discharge apparatus for use in discharging a stencil sheet used in a stencil printing machine, and more particularly a stencil printing machine capable of accurately detecting a stored amount of used stencil sheets at the stencil discharge section, a stencil discharge device of a stencil printing machine and a stencil printing system.

2. Description of the Related Art

In the case of the stencil printing machine, it is necessary for discharging a stencil sheet fixed to a printing drum after completion of the printing operation prior to next perforating. The stencil discharging operation is carried out by a method wherein a peeling claw enters between the printing drum and the stencil sheet and the printing drum is rotated to feed out the stencil sheet into a discharge box. Within the discharge box are installed a compressing mechanism for compressing the stencil sheets or the like in order to increase a storing amount of the stencil sheets after their discharging operation.

Then, when the stored number of stencil sheets within the discharge box reaches a predetermined number of sheets (for example, it is filled with the sheets), the discharge box is taken out of the apparatus and the stencil sheets stored in the box are deposited.

The stencil sheet discharge apparatus is provided with a sensing means for sensing the number of sheets capable of being stored in the discharge box. This sensing means stores the present storing amount in a memory section, and calculates a residual amount of sheets in respect to the set number of sheets at an arithmetic section. In addition, there is also provided a filled amount sensing system for use in sensing a state when the discharge box is filled with sheets. Further, there is also provided a system combined with these devices.

However, in the case of these sensing means, it could not know an absolute capacity (a residual amount of discharge sheets) within the discharge box so long as the discharge box is taken out or the discharge box is not filled with discharge sheets.

In addition, since there was a certain difference in the number of discharge sheets capable of being stored in reference to a difference in the type of machine or state of application in use, a mechanism of sensing a residual amount of sheets detected through the memory section was required to have a predetermined surplus amount in the set value for the filled stencil sheets to be discharged. With such an arrangement as above, there was sometimes a possibility that the amount of discharge sheets capable of being stored in the discharge box was lower than an actual stored state.

Further, in the case that the discharge box is taken out during the operation, a stored state of the stencil sheets within the discharge box can not be discriminated accurately. For example, in the case of configuration in which the memory is cleared by taking-out the discharge box, if the stencil sheets within the discharge box are not deposited and the box is fixed again to the device, the residual amount of sheets in the memory is different from the actual value of the number of sheets.

In this case, even if the discharge box is filled with the sheets subsequently discharged, it is discriminated that the device is not filled with the sheets and an inferior discharge occurs (such as a jamming or the like). In addition, in the case that only part of the stencil sheets was taken out when the discharge box was taken out, a value at the memory section in the device was different from the stored state in the discharge box to produce an inconvenient state in operation.

The present invention has been invented in order to solve the aforesaid problems and it is an object of the present invention to provide a stencil printing machine capable of performing an accurate sensing of a stored state of the stencil sheets in the discharge box and further informing an appropriate time of deposition for the sheets, a stencil discharge apparatus for the stencil printing machine and a stencil printing system.

SUMMARY OF THE INVENTION

According to a first aspect of this invention, there is provided a stencil discharge apparatus for a stencil printing machine having a discharge box for storing a predetermined amount of stencil sheets after being peeled off from a printing drum so as to discharge said stencil sheets. The stencil discharge apparatus includes compressing means for compressing the stencil sheets discharged into said discharge box through motion of a compressing plate; compressing pressure sensing means for sensing and outputting a compressing pressure of said compressing means; moving amount sensing means for sensing and outputting an amount of motion of said compressing plate; and control means for calculating a storing amount of the stencil sheets in said discharge box on the basis of sensing of a predetermined pressure through said compressing pressure sensing means and an amount of motion sensed by said moving amount sensing means.

In accordance with the aforesaid configuration, the stencil sheets are compressed by the compressing means every time the stencil sheets are stored (discharged) into the discharge box. The control means calculates a storing amount of the stencil sheets in response to a moving amount of the compressing plate during compressing operation. Since the storing state in the discharge box can be directly sensed through motion of the compressing plate, it becomes possible to calculate an accurate amount of discharging stencil sheets.

According to a second aspect of this invention, in the first aspect of the present invention, there can be provided a stencil discharge apparatus for a stencil printing machine in which said control means calculates a residual amount of sheets capable of being stored in said discharge box in response to a limited storing amount of said discharge box and an amount of motion of said compressing means.

In accordance with the aforesaid configuration, the control means is enabled to know a dischargeable amount of said sheets every time in order to calculate a residual amount of the discharge sheets.

According to a third aspect of this invention, in the first or the second aspect of the present invention, there can be provided a stencil discharge apparatus for a stencil printing machine having a display device for displaying a storing amount of said stencil sheets or a residual amount which can be stored.

In accordance with the aforesaid configuration, a storing amount of the stencil sheets and/or a residual amount which can be stored is displayed on the display device and it can be easily confirmed.

According to a fourth aspect of this invention, in the first aspect of the present invention, there can be provided a stencil discharge apparatus for a stencil printing machine in which said control means alarms when the residual amount becomes less than a specified value in response to a storing limit amount of said discharge box and an amount of motion of said compressing means.

In accordance with the aforesaid configuration, since the external informing operation is carried out when the residual amount in the discharge box becomes less than a specified value, it becomes possible to inform the discharging of stencil sheets in the discharge box at a proper time and deposit the sheets.

In accordance with a fifth aspect this invention, in the first aspect of the present invention, there can be provided a stencil discharge apparatus for a stencil printing machine in which said control means includes a memory means for storing a storing amount of stencil sheets within said discharge box; the storing amount of the stencil sheets stored within said discharge box is calculated on the basis of an amount of motion sensed by said moving amount sensing means when said compressing pressure sensing means senses a predetermined pressure upon compressing the stencil sheet with the compressing means; and the storing amount of the stencil sheet is stored in said memory means.

In accordance with the aforesaid configuration, since a storing amount of stencil sheets is calculated every time the sheet is discharged, revised and stored in the memory means, mere reading-out of the content stored in the memory means enables an amount of storing in the discharge box to be accurately known even under a state before discharging a sheet.

According to a sixth aspect of this invention, in the fifth aspect of the present invention, there can be provided a stencil discharge apparatus for a stencil printing machine in which said control means reads out the storing amount of the stencil sheets stored in the memory means when said stencil sheets are discharged and causes compressing operation of the compressing means not to be executed when said storing amount is less than a predetermined amount.

In accordance with the aforesaid configuration, the compressing operation performed by the compressing means is not performed when a storing amount in the discharge box is less than a predetermined amount, resulting in that it is possible to restrict a useless consumption of electrical power.

According to a seventh aspect of this invention, in the first aspect of the present invention, there can be provided a stencil discharge apparatus for a stencil printing machine in which said control means causes the stencil sheets to be compressed with said compressing means when a power supply is turned on and calculates the storing amount of the stencil sheets within said discharge box on the basis of an amount of motion sensed by said moving amount sensing means when said compressing pressure sensing means senses a predetermined pressure.

In accordance with the aforesaid configuration, since a compressing operation is actually carried out to calculate a storing amount of the stencil sheets within the discharge box when the power supply is turned on again, it becomes possible to attain an accurate storing amount even if a storing amount in the discharge box is changed due to a deposition of the discharge sheet during a time in which the power supply is turned off.

According to an eighth aspect of this invention, in the first aspect of the present invention, there can be provided a stencil discharge apparatus for a stencil printing machine in which said control means performs an external alarm when it is judged that the storing amount of the stencil sheets after printing exceeds a storing limit amount of said discharge box in the case where an operating input for performing the printing is set as accompanied by discharging a plurality of the stencil sheets.

In accordance with the aforesaid configuration, although there occurs a case in which the discharge box is filled with sheets in the midway part of printing operation for discharging a plurality of sheets, it is judged if a storing amount of the stencil sheets exceeds the storing limit amount of said discharge box before executing the printing operation under this state and if it exceeds the amount, it is alarmed in advance. With such an arrangement as above, it becomes possible to prevent in advance that the sheets can not be discharged in the midway part of printing operation and the printing operation is stopped.

According to a ninth aspect of this invention, in the eighth aspect of the present invention, there can be provided a stencil discharge apparatus for a stencil printing machine including an operating panel for operating and inputting a number of the stencil sheets to be perforated.

In accordance with such a configuration as described above, it becomes possible to know at once whether the discharging operation corresponding to the number of stencil sheets performed by the present printing operation can be carried out by performing an inputting operation of the number of sheets with the operating panel.

According to a tenth aspect of this invention, in the first aspect of the present invention, there can be provided a stencil discharge apparatus for a stencil printing machine in which said control means is connected to a computer through a network and transmitted an alarm to the competer when it is judged that the storing amount of the stencil sheets after printing exceeds a storing limit amount of said discharge box in the case where printing is performed in reference to a number of the stencil sheets inputted from said terminal.

In accordance with the aforesaid configuration, in the case that a printing instruction is generated from a remote terminal through a network connection, it is judged whether a storing of the sheet into the discharge box can be carried out in response to the number of sheets when the printing accompanied by a plurality of sheets is performed, and if it is not possible, an alarm is transmitted. With such an arrangement as above, it becomes possible to prevent that the sheet can not be discharged in the midway part of the printing operation and the printing operation is stopped, resulting in that a network printing using a remote stencil printing machine can be carried out smoothly under an instruction dispatched from the terminal.

According to an eleventh aspect of this invention, in the second aspect of the present invention, there can be provided a stencil discharge apparatus for a stencil printing machine in which said control means is connected to a computer through a network and transmits a residual amount of sheets in the discharge box into the computer when printing is started.

In accordance with the aforesaid configuration, it is possible to know at a remote terminal the residual amount of sheets in the discharge box when the printing is started.

According to a twelfth aspect of this invention, there can be provided a stencil discharge apparatus for a stencil printing machine including a discharge box for storing a predetermined amount of stencil sheets after being peeled off from a printing drum; stencil sheet residual amount calculating means for calculating a residual amount of sheets which can be stored in said discharge box in reference to a storing limit amount of said discharge box and a storing amount of stencil sheets discharged into said discharge box; means for inputting a number of originals prior to a case where a processing accompanied by discharging a plurality of the stencil sheets is performed in a continuous manner; and control means for comparing said inputted number of originals with said calculated residual amount and performing an alarm when said number of originals is more than the residual amount.

In accordance with the aforesaid configuration, in the case that a processing accompanied by a plurality of discharged sheets is performed in a continuous manner, the number of originals is inputted prior to the processing to cause the inputted number of originals to be compared with the calculated residual amount and an alarm is produced when the number of originals is more than the residual amount, so that it becomes possible to prevent that the discharge sheet can not be discharged in the midway part of printing operation and the printing operation is stopped.

According to a thirteenth aspect of this invention, in the twelfth aspect of the present invention, there can be provided a stencil printing machine including an automatic document feeder on which a plurality of originals can be mounted; and an operating panel for inputting the number of originals set at said automatic document feeder; wherein said control means compares the number of originals inputted through said operating panel with the residual amount of discharge sheets under an ADF mode using said automatic original feeder.

In accordance with the aforesaid configuration, under an ADF mode using the automatic original feeder, the number of originals inputted through said operating panel is compared with the residual amount of discharge sheets and an alarm is produced when the number of originals is more than the residual amount, so that it becomes possible to prevent that the discharge sheet can not be discharged in the midway part of printing operation and the printing operation is stopped.

According to a fourteenth aspect of this invention, there can be provided a stencil printing system including a stencil printing machine and a computer connected to said stencil printing machine through a network, and the computer receives a printing instruction for said stencil printing machine. The stencil printing system includes a discharge box for storing a predetermined amount of stencil sheets after being peeled off from a printing drum; stencil sheet residual amount calculating means for calculating a residual amount of the sheets which can be stored in said discharge box in reference to a storing limit amount of said discharge box and a storing amount of the stencil sheets discharged into said discharge box; means for setting a number of originals to be processed on the computer prior to continuous processing accompanied by discharging a plurality of the stencil sheets; and control means for comparing said set number of originals with said calculated residual amount and raising an alarm when said number of originals is larger than the residual amount.

In accordance with the aforesaid configuration, since the residual amount of sheets in the discharge box is transmitted to the terminal, it becomes possible to instruct at a terminal a printing of the number of sheets corresponding to the residual amount. With such an arrangement as above, it is possible to prevent that the sheets can not be discharged in the midway part of the printing operation and the printing operation is stopped and then a network printing using the remote stencil printing machine can be carried out smoothly under an instruction attained from the terminal.

BRIEF DESCRIPTION OF THE DRAWINGS

FIG. 10 is a flow chart for showing a control processing when a power supply for an apparatus of a third preferred embodiment of this invention is turned on.

FIG. 14(*b*) is a flow chart for showing an alarm processing of a discharge stencil when a network printing is carried out.

FIG. 17(*b*) is a flow chart for showing an alarm processing of a discharge stencil when a network printing of a seventh preferred embodiment of this invention is carried out.

DETAILED DESCRIPTION

First Preferred Embodiment

Figure 1:
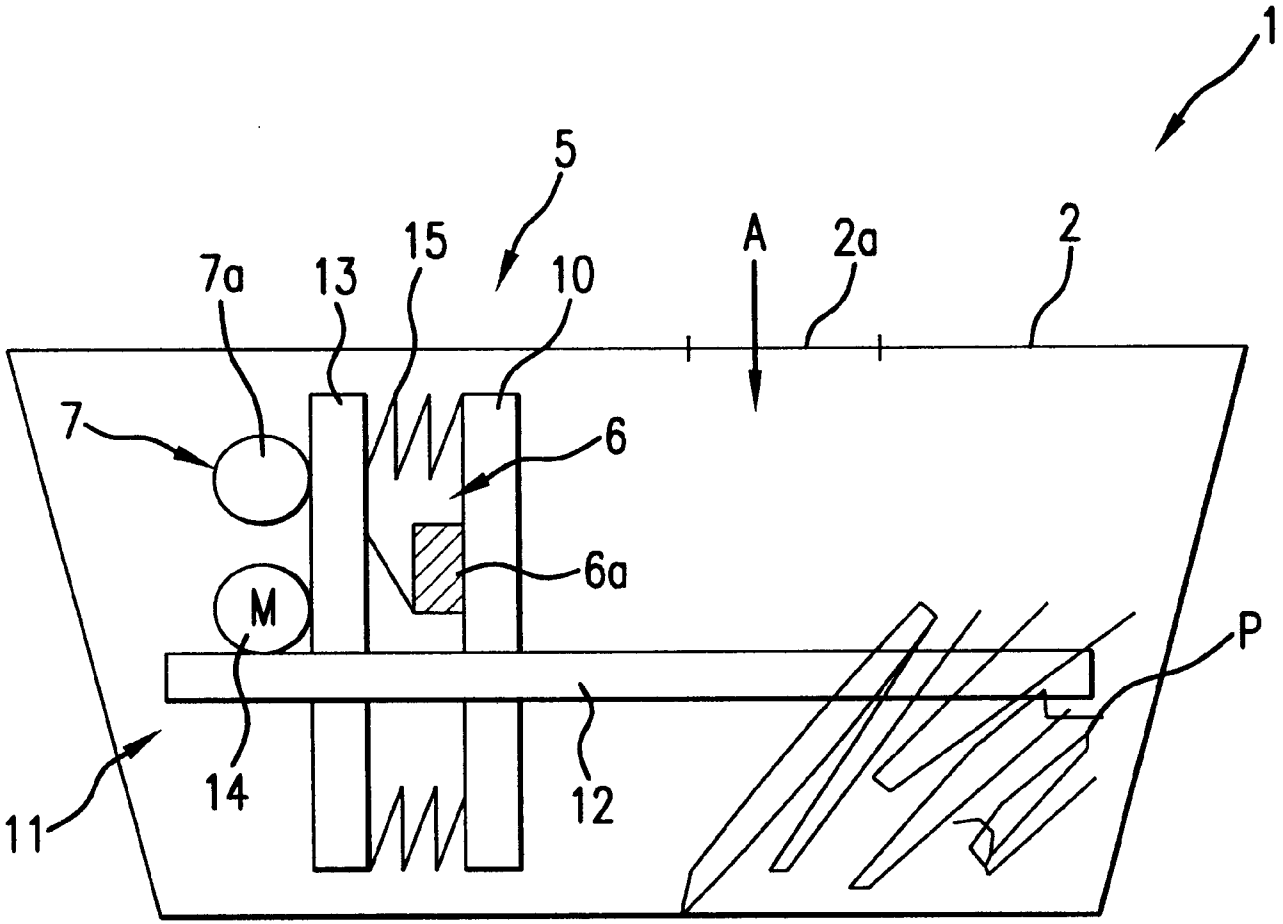
FIG. 1 is a side elevational view for showing a first preferred embodiment of a stencil discharge apparatus for a stencil printing machine of this invention.

FIG. 1 is a side elevational view for showing a stencil discharge apparatus for a stencil printing machine of this invention.

This stencil discharge apparatus 1 is arranged near an outer circumference of a printing drum rotated within a stencil printing machine. Upon completion of the printing operation, prior to next perforation, a peeling claw enters between the printing drum and a stencil sheet and the stencil sheet P is peeled off from the printing drum through rotation of the printing drum. Concurrently, the stencil sheet P is fed out toward a discharge box 2 (a direction A in the figure).

The discharge box 2 is formed as an inner hollow box shape, wherein the stencil sheet P is fed into the box through an opening 2*a*.

Within the discharge box 2 are arranged a compressing means 5 for compressing the stencil sheet P, a compressing pressure sensing means 6 for sensing a compressing pressure of the compressing means 5 and a moving amount sensing means 7 for sensing an amount of motion of the stencil sheet P when the sheet is compressed by the compressing means 5.

The compressing means 5 in this preferred embodiment is comprised of a compressing plate 10 arranged within the discharge box 2, and a moving means 11 for moving the compressing plate 10 in a compressing direction. The moving means 11 has, outside (both sides) of the discharge box 2, a rail 12 extending in a longitudinal direction of the discharge box 2 and a moving plate 13 movable on the rail 12. The moving plate 13 moves on the rail 12 under a rotation of a motor 14. For example, a rack-gear is arranged at the rail 12 and a pinion-gear is arranged at the moving plate 13.

A resilient member (a spring or the like) 15 is arranged between the moving plate 13 and the compressing plate 10, and the compressing plate 10 is biased against the moving plate 13 in a direction spaced apart by a predetermined distance.

The compressing pressure sensing means 6 senses a compressing pressure when the stencil sheet P is compressed with the compressing means 5. For example, this is comprised of a micro-switch 6*a* arranged at the compressing plate 10. When a spacing between the compressing plate 10 and the moving plate 13 is narrowed to a predetermined distance during compressing operation, a sensing signal is outputted.

A moving amount sensing means 7 senses a moving amount of the compressing plate 10. For example, it is comprised of a pulse encoder 7*a* for sensing a rotation of the motor 14. When the motor 14 is rotated, a sensing signal corresponding to a moving amount of the compressing plate 10 (a moving plate 13) moved on the rail 12 is outputted. In addition, the moving amount is sensed by a resistor outputting a resistance value corresponding to the rotation to a power transmitting shaft of the motor 14 fixed to the shaft.

Figure 2:
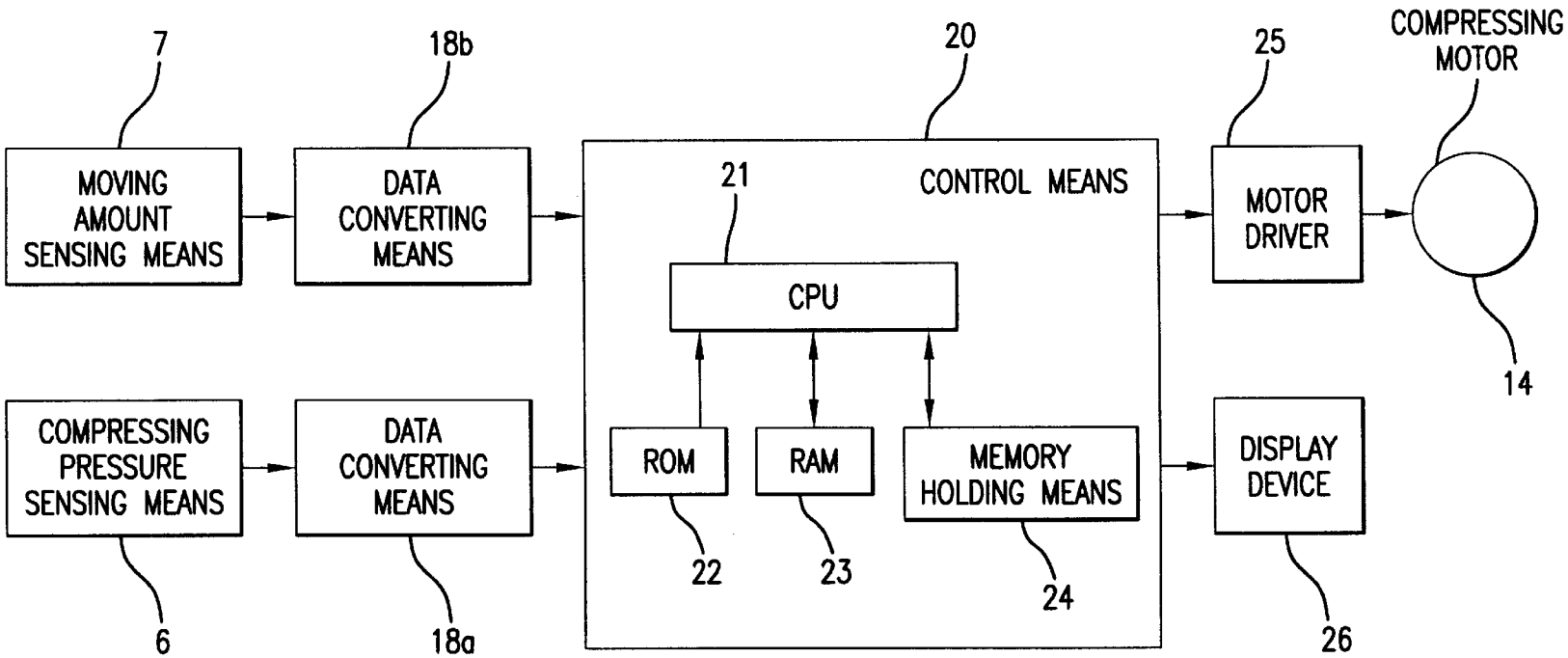
FIG. 2 is a block diagram for showing an electrical configuration of a stencil discharge apparatus.

FIG. 2 is a block diagram for showing an electrical configuration of a stencil discharge apparatus.

Each of sensing signals of the moving amount sensing means 7 and the compressing pressure sensing means 6 is changed by data converting means 18*a*, 18*b* into a signal format processed by a control means 20.

The control means 20 is comprised of a CPU 21, a ROM 22, a RAM 23 and a memory holding means 24 and the like and this can be constituted by a general-purpose computer device. A storing amount of stencil sheets to be described later and a residual amount of discharged stencil (a residual amount) are stored in the RAM 23 in such a manner that they can be revised and similar data is transferred to the memory holding means 24 every time the content of the RAM 23 is revised. The memory holding means 24 is comprised of HDD or the like and this is comprised of a device for holding the stored state of data even in the case that a power supply for the apparatus is turned off.

This control means 20 performs an operation control to be described later, calculates a residual amount of discharged stencil within the discharge box 2 and outputs it by a method wherein the CPU 21 executes a predetermined control program.

In addition, a motor driver 25 is a driving circuit for use in operating the motor 14. A display device 26 displays various kinds of operating contents to be described later.

Then, an operation of the aforesaid configuration will be described as follows.

Figure 3:
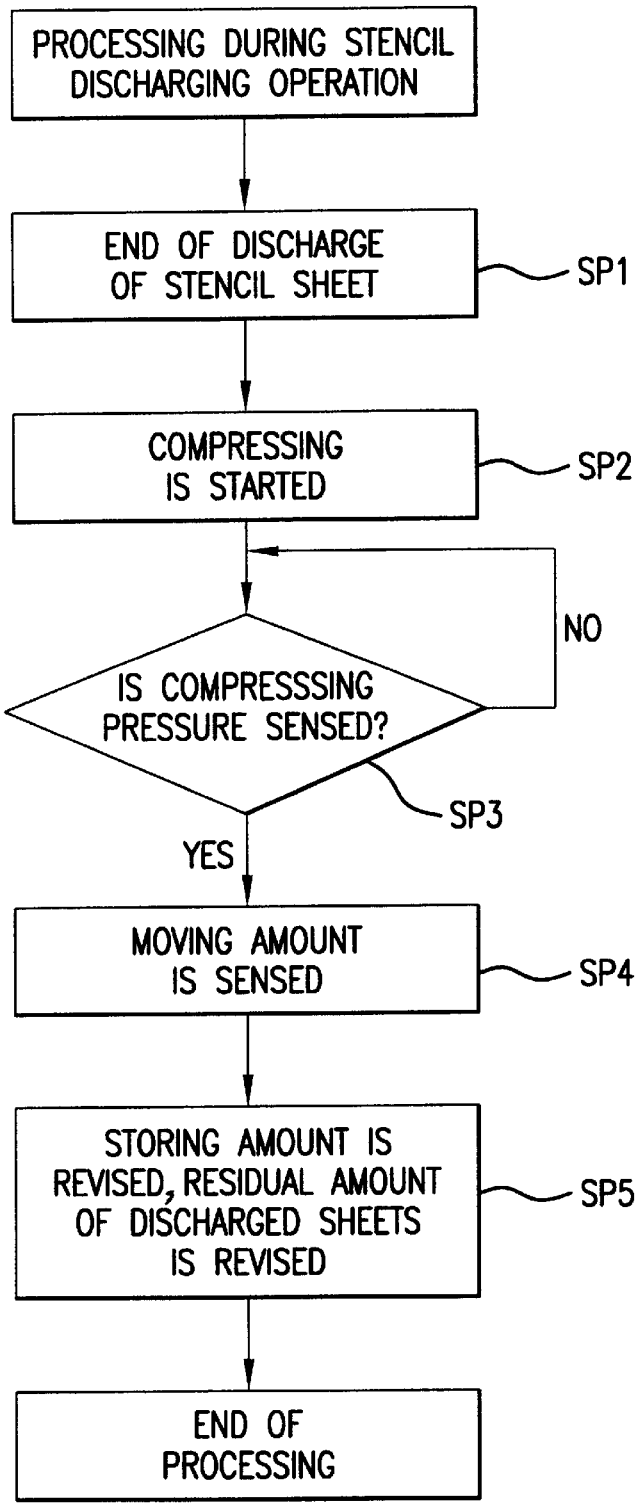
FIG. 3 is a flow chart for showing a control processing for calculating a discharge amount.

FIG. 3 is a flow chart for use in sensing an amount of discharged stencils performed by the control means 20. This sensing of the amount of discharged stencils is executed every time the stencil sheet P is discharged into the discharge box 2.

At first, as the stencil sheet P is discharged into the discharge box 2 (SP1), a compressing of the stencil sheet P is started (SP2). The stencil sheet P is peeled off from the printing drum and transported into the discharge box 2. The discharging is sensed by a sensor arranged near the opening 2*a* (side of the apparatus).

At first, the motor 14 for the compressing means 5 is rotated and the moving plate 13 is slid in a rightward direction as viewed in FIG. 1 on the rail 12. With such an arrangement as above, the compressing plate 10 in front of the moving plate 13 is contacted with the stencil sheet P and then the sheet is gradually compressed. Correspondingly, the resilient member 15 is shrunk.

Figure 4:
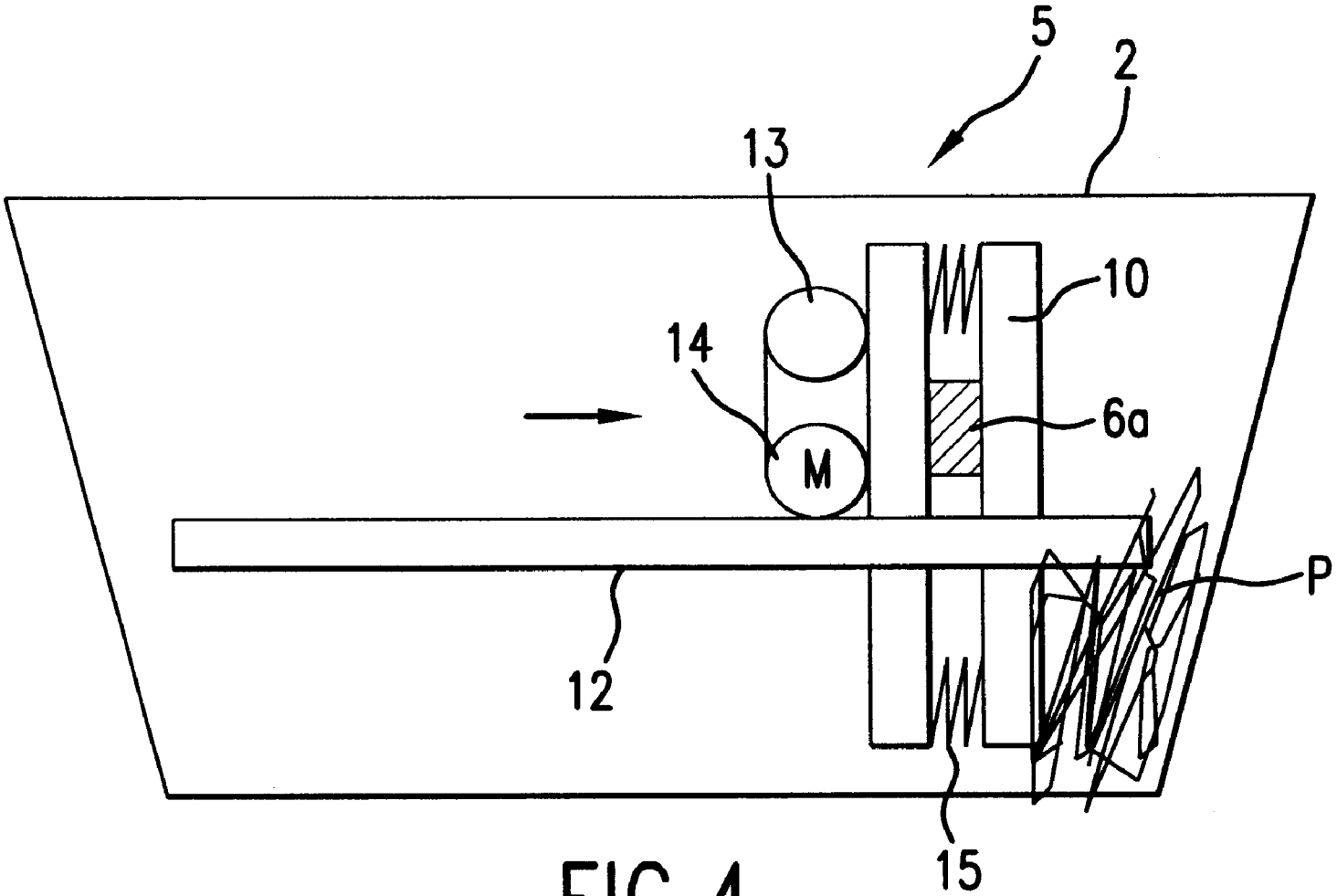
FIG. 4 is a side elevational view for showing an operation of a stencil discharge apparatus.

Then, as indicated in an operation diagram in FIG. 4, the micro-switch 6*a* constituting the compressing pressure sensing means 6 is operated when the stencil sheet P is under a predetermined compressed state and then the compressed state is sensed and outputted (SP3-YES).

The control means 20 takes a sensing signal of a moving amount sensing means 7 when a compressing pressure sensing signal is inputted (SP4).

The control means 20 calculates a storing amount of the stencil sheets P within the discharge box 2 and a residual amount of stencil sheets attained from the former, revises them and stores them in RAM 23 (SP5). The content of the RAM 23 is transferred to the memory holding means 24 so as to back up data about the storing amount and the residual amount of discharge stencils.

Within the ROM 22 of the control means 20 is set in advance in a form of look-up table a relation between the moving amount of the moving means 11 and the storing amount of the stencil sheets P. In addition, there may be provided a residual amount of discharged stencil sheets in which a stored amount is subtracted from the storing limit amount within the discharge box 2.

Accordingly, the control means 20 can attain a storing amount and a residual amount of discharged sheets in reference to a moving amount indicated by a sensing signal outputted from the moving amount sensing means 7.

Figure 5:
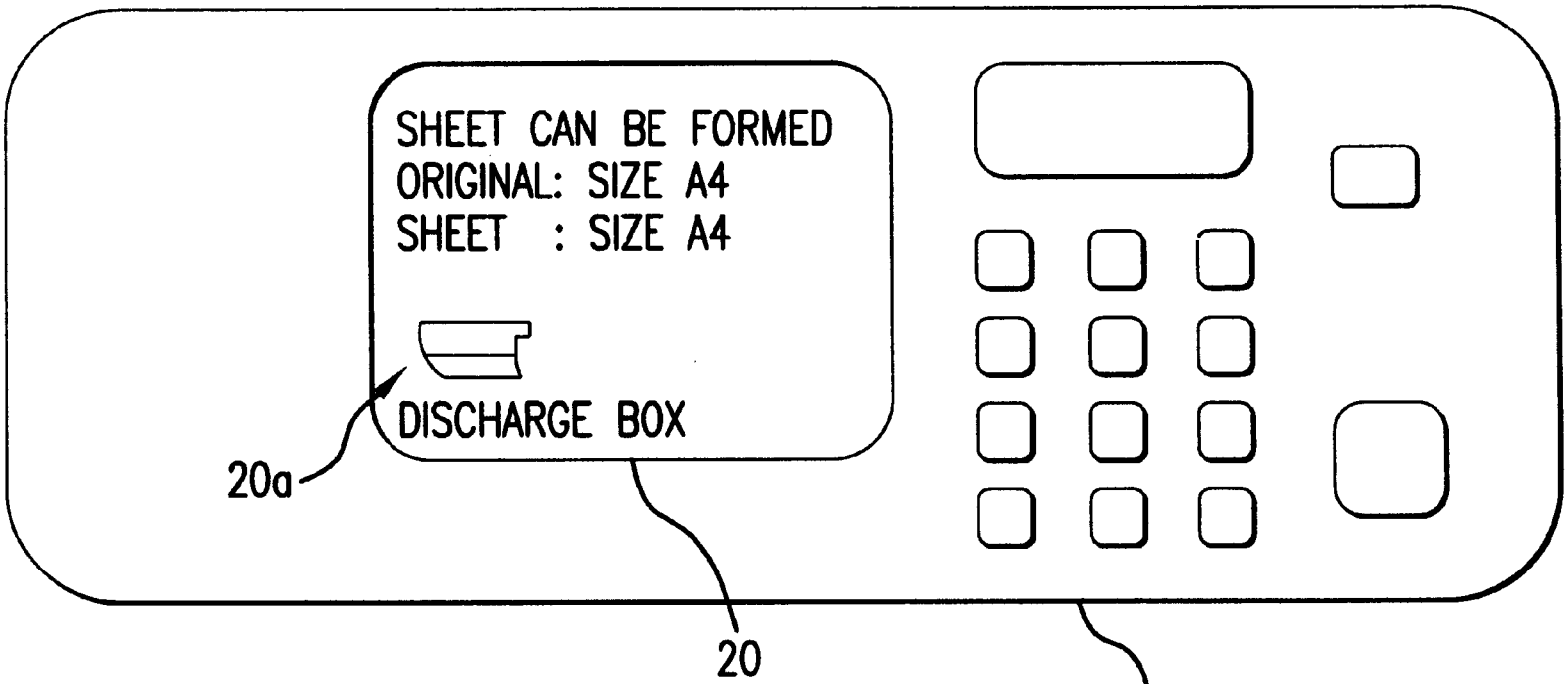
FIG. 5 is a view for showing an example of display of a stored state in a discharge box.

FIG. 5 is a view for showing a displayed state of the residual amount of discharged stencil sheets at the display device 26.

The display device 26 is constituted by an LCD or the like arranged on the operating panel 30 of the stencil printing machine.

On this display device 26 are displayed a storing amount of the stencil sheets P stored in the RAM 23 and an indicator 26*a*indicating the residual amount of discharged stencil sheets. This indicator 26*a* displays the storing amount of the stored stencil sheets P with a black color within a frame line indicating an outer shape of the discharge box 2 and the residual amount of the discharged stencil sheets is displayed in white blank state.

It is possible to display in a real time mode both the storing amount and the residual amount of the discharged stencil sheets by this indicator 26*a*. In addition, the residual amount of the discharged stencil sheets may be displayed on the LCD in a numerical value. Further, in the case that the stencil printing machine is connected with an upper device like a personal computer, it may also be applicable that the storing amount and the residual amount are displayed by the upper device.

The aforesaid compressing means 5 is returned back again to its initial position (the position illustrated in FIG. 1) after the compressing operation for the stencil sheets P is performed so as to enable the stencil sheets P discharged subsequently to be taken into the device.

Figure 6:
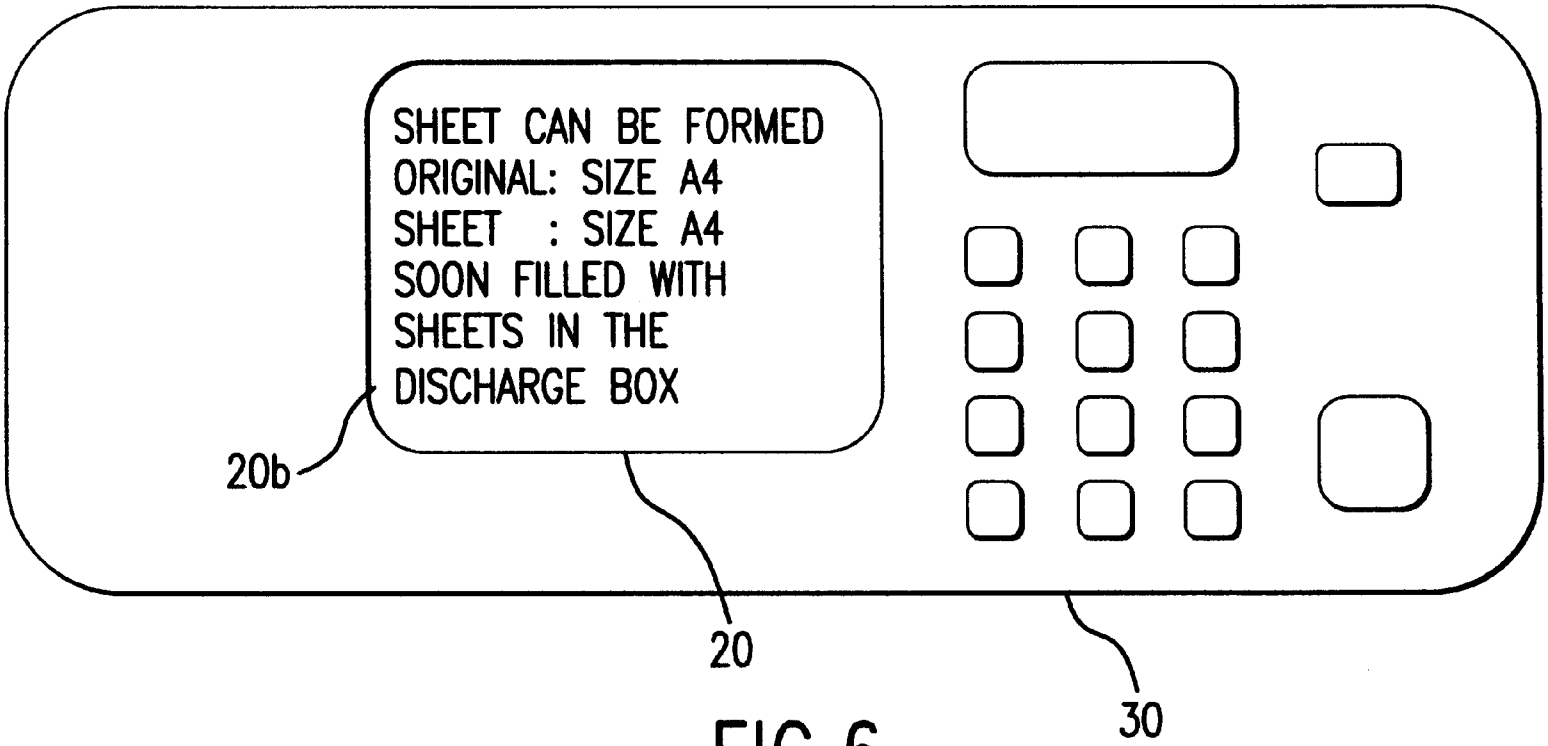
FIG. 6 is a view for showing an example of display when an inner side in a discharge box approaches a storing limit state.

In addition, the control means 20 performs a pre-displaying on the display device 26 as shown in FIG. 6 when the residual amount of stencil sheets in the discharge box 2 is less in residual state. For example, as shown in the figure, it may display "The discharge box will be filled with sheets very soon" in a row of letters 26*b*.

Figure 7:
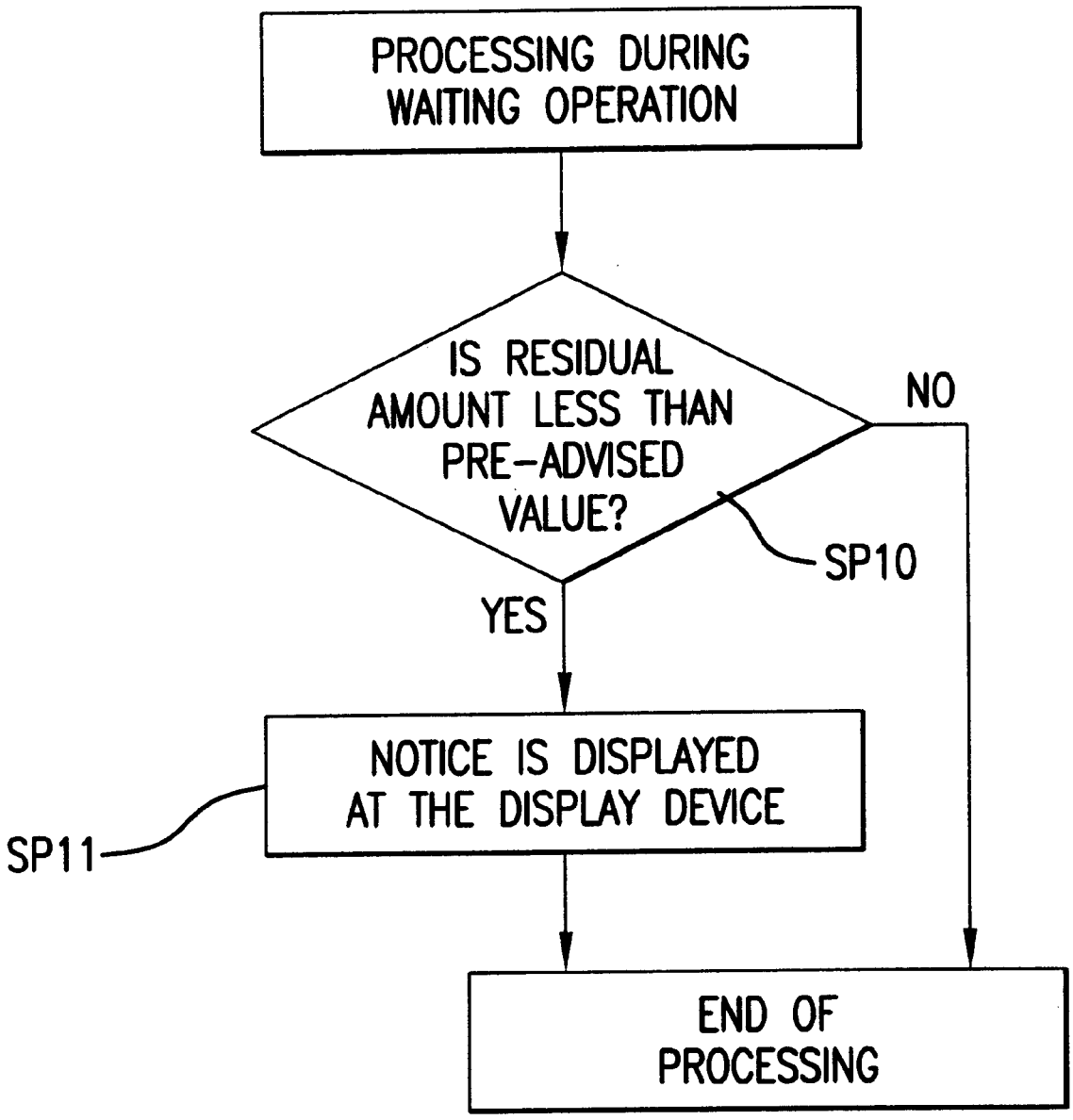
FIG. 7 is a flow chart for showing a control operation when an inner side in a discharge box approaches a storing limit state.

FIG. 7 is a flow chart for a pre-displaying operation.

In the control means 20, a specified value (a pre-advised value) corresponding to a time of pre-displaying operation is stored. Accordingly, when the residual amount of the discharged stencil sheets is less than the pre-advised value (SP10-YES), the aforesaid pre-advised display is carried out (SP11).

More practically, the aforesaid pre-advised display is carried out continuously during a period subsequent to a situation in which a moving amount of the moving amount sensing means 7 reaches this pre-advised value.

Second Preferred Embodiment

A second preferred embodiment of this invention will be described as follows.

To the stencil printing machine is connected an ADF (an automatic document feeder) and there occurs sometimes that many printed documents are attained from a plurality of originals in a continuous manner (called as "ADF mode"). Under this ADF mode, one stencil sheet per one original is formed and the printing is carried out continuously up to a predetermined number of sheets under application of one stencil sheet. As to a printing of sheets more than a predetermined number, the sheet is read once again to form one stencil sheet and similarly the printing is carried out. In the case that this ADF mode is applied for operation, it is sometimes performed that a sorter is separately connected to the stencil printing machine and a sorting operation is carried out.

An operator specifies this ADF mode and then causes the device to perform stencil making and stencil discharging operations in an automatic manner. Due to this fact, there is a possibility that the discharge box 2 is filled with sheets in midway of discharging sheet operation for the stencil sheet P under an absence of the operator.

In this case, the number of originals can be inputted through the ten-key on the operating panel 30 and the control means 20 may attain the number of the stencil sheets P required in the ADF mode operation, i.e. the number of discharged stencil sheets P which will be discharged into the discharge box 2 during the ADF mode.

Figure 8:
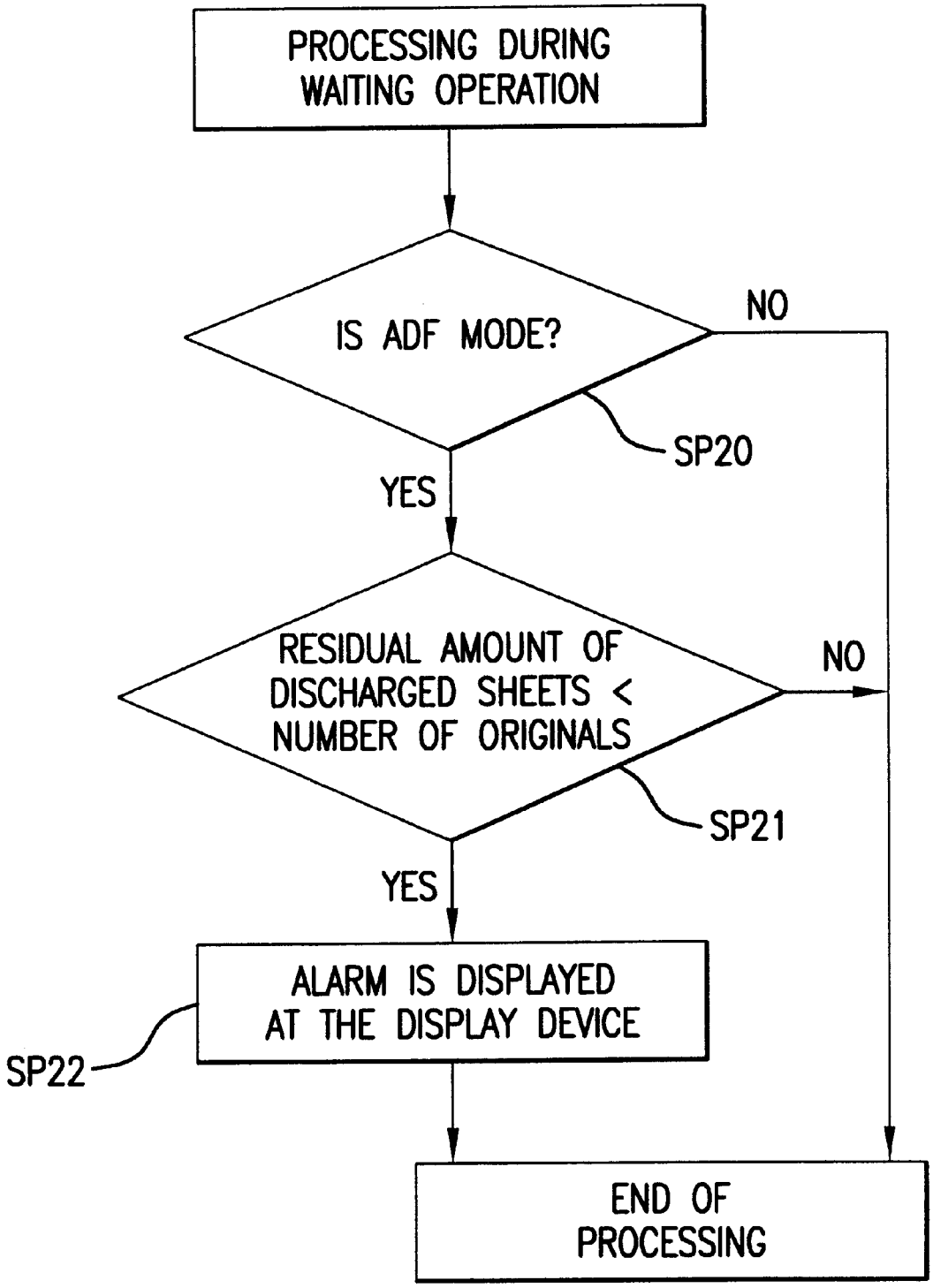
FIG. 8 is a flow chart for showing a control processing when a continuous printing of a second preferred embodiment of this invention is carried out.

FIG. 8 is a flow chart for indicating an alarm display operation in the ADF mode.

When an operator selects "ADF mode" (SP20-YES) and the number of originals is inputted, the control means 20 compares the residual amount of discharged stencil sheets stored in the RAM 23 with the number of originals (the number of stencil sheets). Then, when the number of originals (the number of stencil sheets) exceeds the residual amount of discharged stencil sheets (SP21-YES), an alarm is displayed at the display device 26 (SP22).

Figure 9:
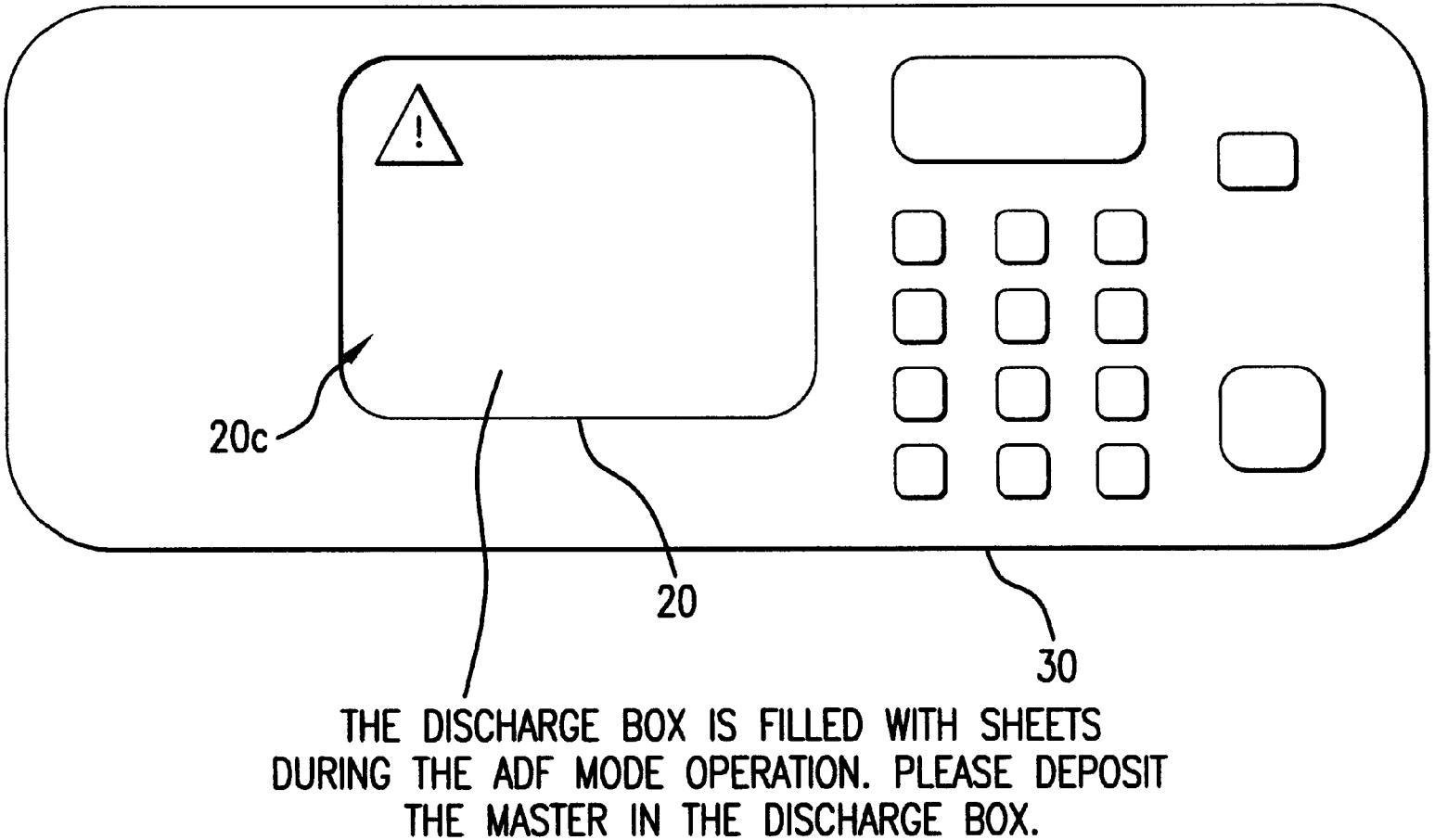
FIG. 9 is a view for showing an example of display of an alarm when a continuous printing is carried out.

As a content of the alarm, "The discharge box is filled with sheets during the ADF mode operation. Please remove the stencil sheets in the discharge box." is displayed on the display device 26 in a row of letters 26*c* as shown in FIG. 9.

In this way, the control means 20 may display an alarm when it is judged that the stencil sheets P can not be stored in the discharge box 2 under the ADF mode.

In the aforesaid processing, although its configuration is made such that the residual amount of discharged stencil sheets is compared with the number of originals (the number of stencil sheets) when the number of originals is inputted and an alarm is performed when the residual amount of the sheets is lower than the number of originals, this invention is not restricted to this form.

For example, it may be constituted such that the residual amount of discharged stencil sheets is compared with the number of originals when a start button for printing operation is depressed after the number of originals is inputted and an alarm is performed when the residual amount of the sheets is lower than the number of originals.

Third Preferred Embodiment

A third preferred embodiment of this invention will be described as follows.

Figure 10:
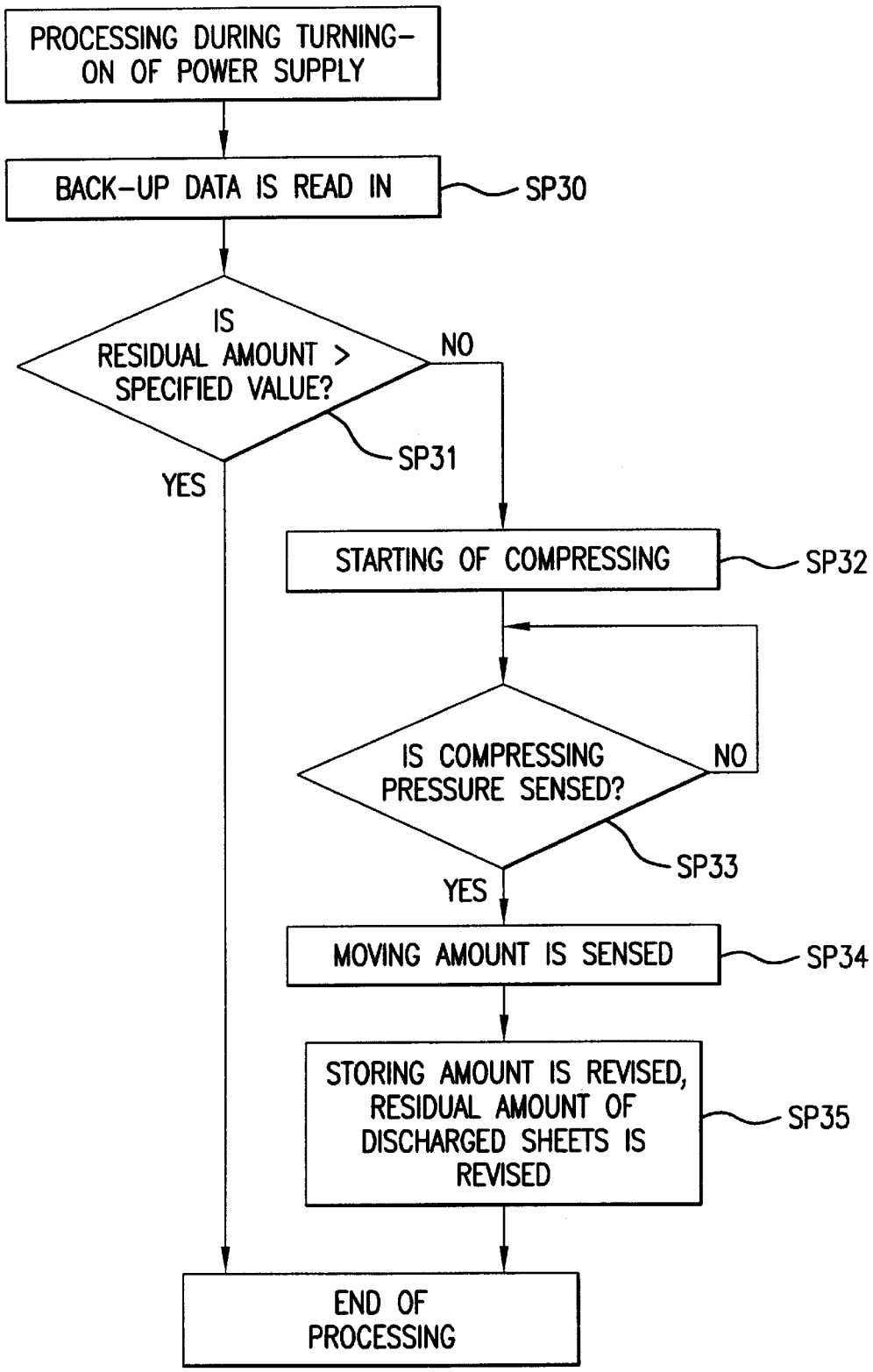

The third preferred embodiment relates to an operation control of the control means 20 when the power supply is turned on, and this will be described in reference to the flow chart shown in FIG. 10.

When the power supply for the device (the stencil printing machine) is turned off, the storing amount of the sheets and the residual amount of discharged sheets stored in the RAM 24 are deleted. In addition, there occurs a possibility that the stencil sheets P in the discharge box 2 are removed during a period in which the power supply is turned off.

Performing the flow chart shown in the figure prevents occurrence of disadvantages based on these items.

At first, the control means 20 reads the storing amount and the residual amount of discharged stencil sheets backed up in the memory holding means 24 when the power supply for the device is turned on (SP30).

Then, it is discriminated whether the read residual amount of discharged sheets is more than the specified value (SP3 1). This specified value is set to a half value of the storing limit amount which can be stored in the discharge box 2, for example. It is set to be a larger value than the pre-advised value described at least in SP10.

As a result of discrimination, when the residual amount of discharged sheets is more than the specified value (SP3 1-YES), the processing at the time of turning-on of the power supply is completed.

In turn, as a result of discrimination, when the residual amount of discharged sheets is equal to or lower than the specified value (SP31-NO), the compression control (SP32) is started. In this case, whether or not the storing amount is more than the specified value can be applied as a standard for discrimination at the SP31 in place of the residual amount of discharged sheets.

The control means 20 may execute the same control as that for the aforesaid processings at SP2 to SP5. The stencil sheets P are compressed by the compression means 5. Then, a sensing signal of the moving amount sensing means 7 when the micro-switch 6*a* is operated is taken. Then, the residual amount of discharged sheets within the discharge box 2 is calculated in response to the sensed moving amount, revised and stored in the RAM 23. In addition, it is backed up in the memory holding means 24.

As described above, when the power supply is turned on, the compressing operation is executed to sense a residual amount of the discharged sheets in the discharge box 2. With such an arrangement as above, even in the case, that the stencil sheets P in the discharge box 2 are removed while the power supply is turned off, the residual amount of the discharged sheets in the discharge box 2 can be sensed accurately.

Additionally, the compressing process when the power supply is turned on is carried out only when the residual amount of discharged sheets indicated by the read back-up data is lower than the specified value. That is, when there is a surplus space in the discharge box 2, the compressing process for sensing the aforesaid residual amount of discharged sheets is not carried out. With such an arrangement described above, it is possible to prevent a useless compression work from being performed and to restrict a consumption of electrical power.

Fourth Preferred Embodiment

A fourth preferred embodiment of this invention will be described as follows.

Figure 11:
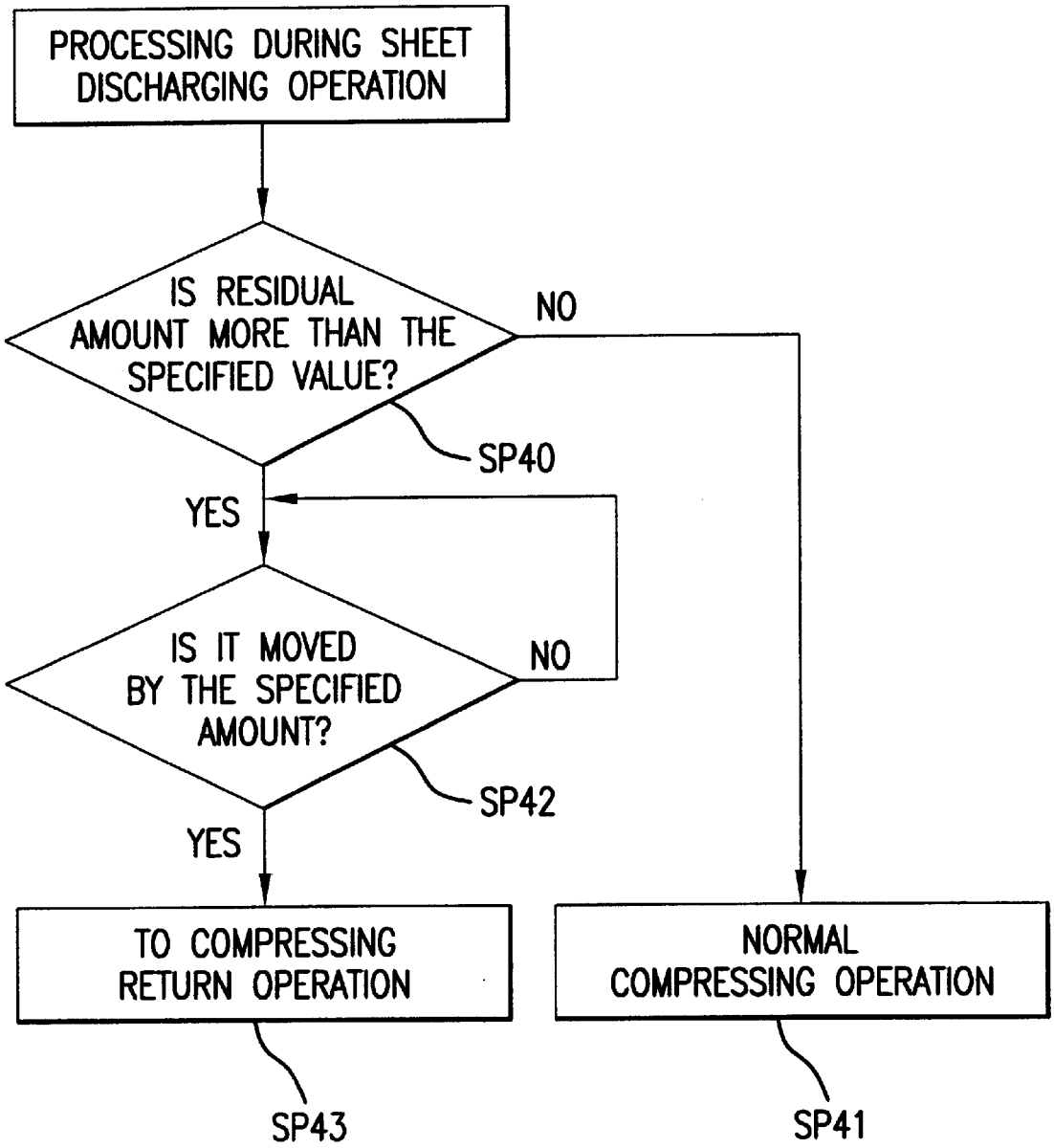
FIG. 11 is a flow chart for showing a control processing when a stencil discharging operation of a fourth preferred embodiment of this invention is carried out.

FIG. 11 is a flow chart for indicating another example of a control configuration.

In the case of the content of processing illustrated in reference to the first preferred embodiment (FIG. 3), the compressing means 5 compresses the stencil sheets P under a predetermined compressing force. That is, a high compressing force is applied under every compressing operation until the compressing pressure sensing means 6 may output the sensing signal.

However, it may not be required that the high compressing force is applied during a period in which the number of stored stencil sheets P within the discharge box 2 is less.

As shown in FIG. 11, when the compressing operation with the compressing means 5 is started, the residual amount of discharged sheets stored in the RAM 23 is compared with the predetermined specified value and judged (SP40). The specified value is set to a half value of a storing limit amount, for example. That is, it may also be applicable that the values applied in SP31 are read out.

As a result of judgement, when the residual amount of discharged sheets is equal to or lower than the specified value (SP40-NO), a usual compressing operation is started (SP41). That is, the processings of SP2 to SP5 shown in FIG. 3 are carried out. With such an arrangement as above, the compressing means 5 may compress the stencil sheets P with a predetermined force. That is, the high compressing force is applied until the compressing pressure sensing means 6 outputs the sensing signal under the compressing operation performed every time.

In turn, when the residual amount of discharged sheets is more than the specified value (SP40-YES), the compressing means 5 is controlled in its operation in such a manner that the compressing pressure may become a lower compressing pressure than that of SP41.

When the compressing means 5 is moved by a predetermined value, for example, (SP42-YES), the compressing means 5 is controlled to be returned back to its initial position (SP43).

In this embodiment described above, when there is a surplus space in the discharge box 2, no useless compressing operation is carried out and a consumption of the electrical power is restricted.

Fifth Preferred Embodiment

Figure 12:
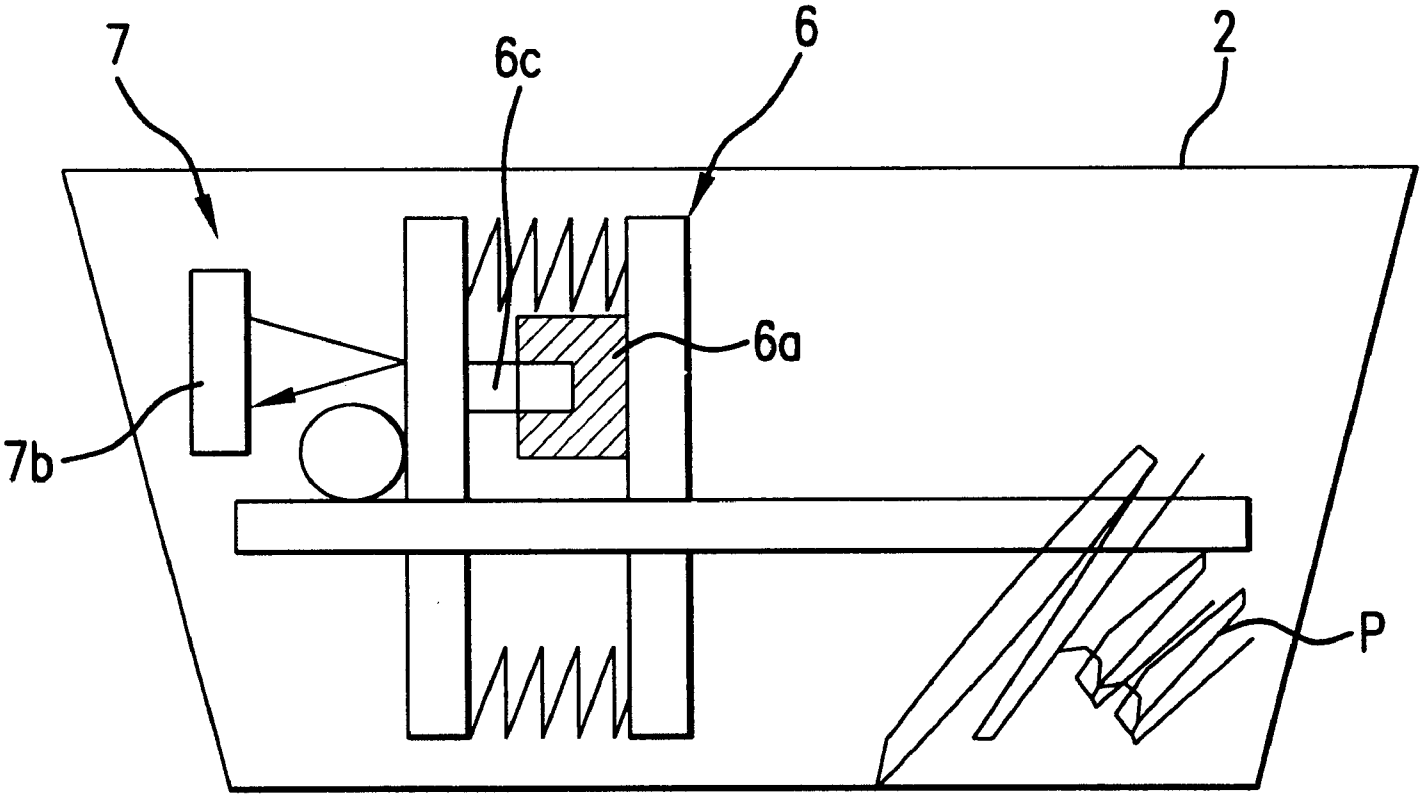
FIG. 12 is a side elevational view for showing a fifth preferred embodiment of this invention.

The stencil discharge apparatus of the fifth preferred embodiment of this invention will be described below. FIG. 12 is a side elevational view for showing a configuration of the fifth preferred embodiment.

In this preferred embodiment, the configuration of the compressing pressure sensing means 6 and the moving amount sensing means 7 are changed. The compressing pressure sensing means 6 is made such that a light transmitting and light receiving integral type photo-sensor 6*b* is arranged at the compressing plate 10 and a shield plate 6*c* for shielding light is arranged at the moving plate 13. In addition, it may also be applicable that as the motor 14, a DC motor is applied and a current value of the DC motor is sensed under an operation of the compressing pressure sensing means 6. The control means 20 can judge that a pressure more than the predetermined value is applied when the current value exceeds the predetermined value.

In addition, the moving amount sensing means 7 is constituted by a distance measuring sensor 7*b* fixed to the device. The distance measuring sensor 7*b* may measure a moving amount of the moving plate 13 under a non-contacted state. For example, it may be constituted by a laser displacement meter. A measuring beam is radiated against the moving plate 13 and a moving amount is sensed in response to the variation of the radiating position of the reflected light as the moving plate 13 is moved. In addition, it may be constituted by a CCD sensor and a linear resistor arranged along the rail 12 can be used.

Sensing signals from the photo-sensor 6*b* and the distance measuring sensor 7*b* are outputted to the control means 20. The control means 20 may execute the same control processing as that of the first preferred embodiment so as to calculate the storing amount and the residual amount of discharged sheets within the discharge box 2.

Even in case of the aforesaid configuration, it is possible to attain the actions and effects similar to those of the aforesaid preferred embodiments.

If the motor 14 having the aforesaid configuration is constituted by a pulse motor, it is possible to convert the moving amount with the pulse count supplied. In this case, the moving amount sensing means 7 is constituted by a counter for counting the supplied pulse. In addition, the data converting means 18*b* converts the counted value into the moving amount.

Further, although the compressing means 5 having the aforesaid configuration is slid in a lateral direction by the moving means 11, this is not limited to this arrangement. For example, it may be constructed such that the compressing plate may be rotatably turned around the rotating shaft. In this case, the motor for the moving means rotates and drives the rotating shaft. In addition, the moving amount sensing means 7 is constituted by a rotary type encoder or a rotary resistor for use in sensing a rotation of the rotating shaft.

In addition, it is not necessary that the motor 14 is placed within the discharge box 2 and it may be constituted such that it may transmit a driving force to the moving means from outside the discharge box 2 through a gear and the like.

Further, if the storing limit amount is kept constant, since the storing amount and the residual amount of discharged sheets are kept to face to each other, it may also be applicable that it may be limited to one of a display at the display device 26 and a storage to the RAM 23 (memory holding means 24) (either the storing amount or the residual amount of discharged sheets).

Sixth Preferred Embodiment

A sixth preferred embodiment of this invention will be described as follows.

Figure 13:
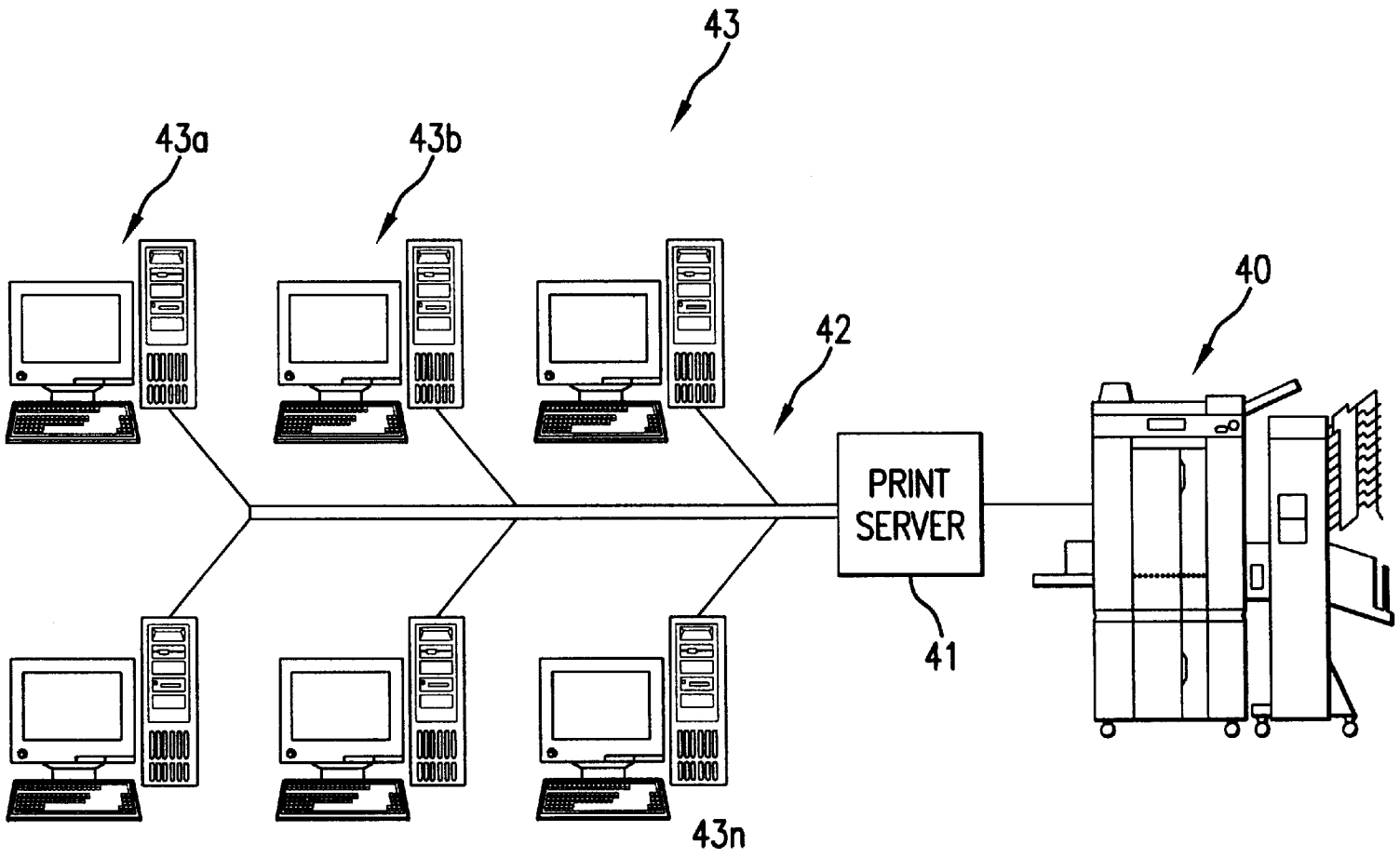
FIG. 13 is a block diagram for showing a configuration of a network printing of a sixth preferred embodiment of this invention.

FIG. 13 is a view for illustrating a network connecting configuration of the stencil printing machine. The stencil printing machine 40 provided with the aforesaid stencil discharge apparatus 1 can be connected to the network 42 through a print server 41. More practically, the control means 20 shown in FIG. 2 is connected to the network 42 through an interface (I/F).

A plurality of computers 43 (43*a* to 43*n*) is connected to this network 42. Each of the computers 43 is constituted by a personal computer having a printer driver assembled therein suitable for the stencil printing machine 40 and then the stencil printing machine 40 can be remotely operated through the network 42. In this case, each of the computers can send original image data to the stencil printing machine 40.

A stencil discharging process using the stencil printing machine 40 which is operated from one of the computers through this network will be described below.

At the computer 43, the number of originals required for printing operation is set when the printing operation is carried out. At the stencil printing machine 40, it is discriminated whether or not the stencil sheets P after use thereof can be stored in the discharge box 2 in response to the number of originals.

Figure 14A:
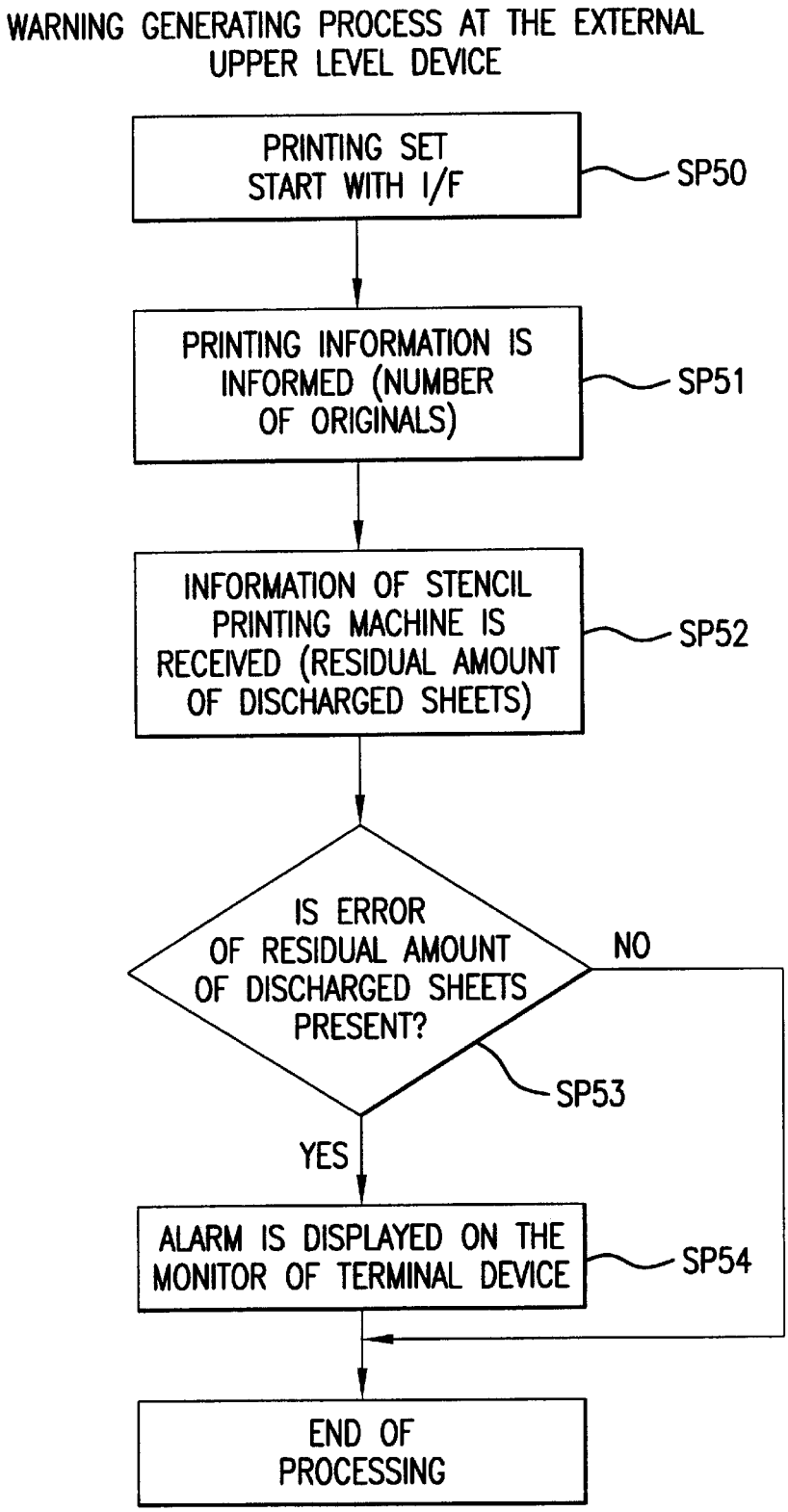
FIG. 14(*a*) is a flow chart for showing an alarm processing of a discharge stencil when a network printing is carried out.
Figure 14B:
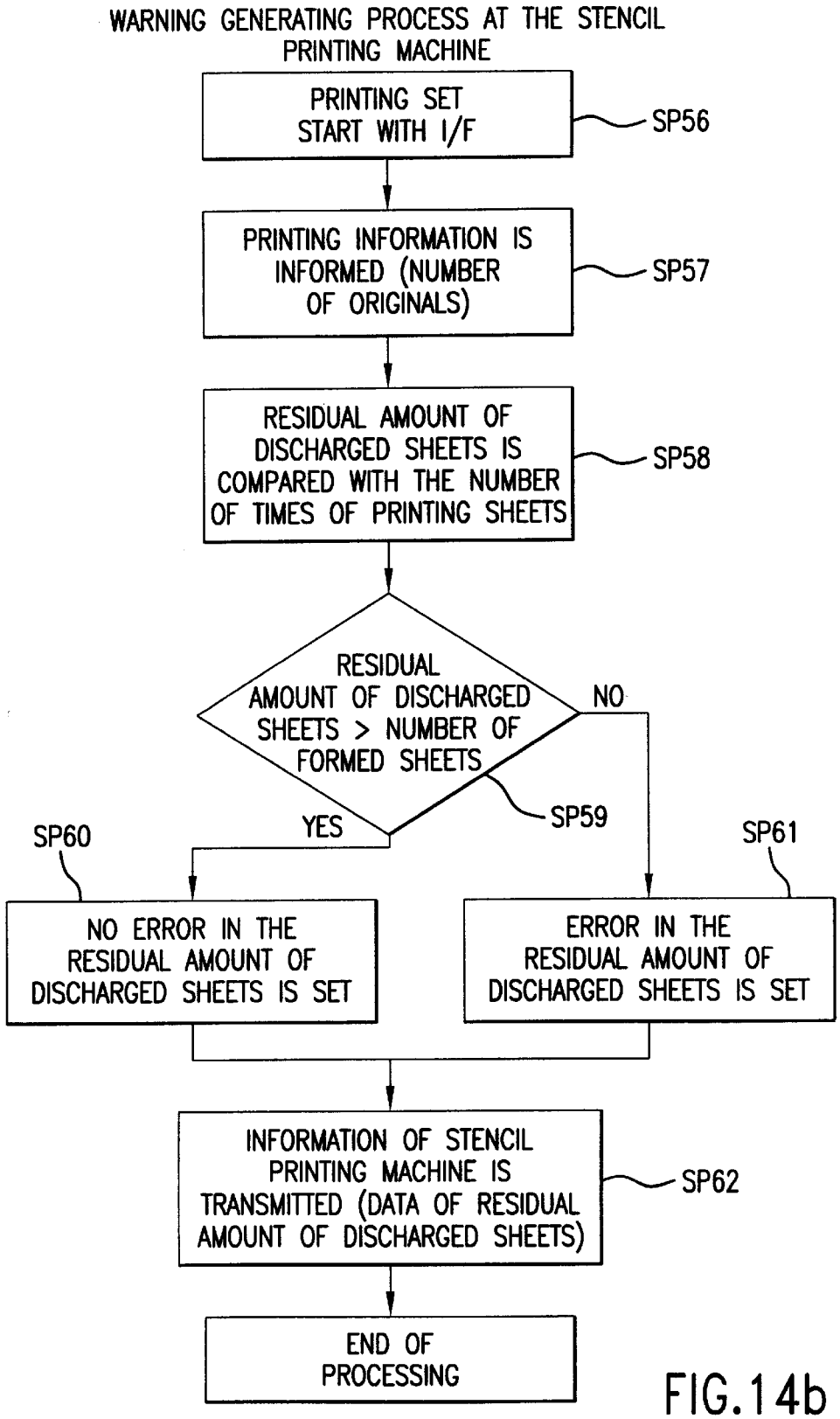

FIGS. 14(*a*) and 14(*b*) are flow charts for indicating a content of processing in which the discriminating processing for the residual amount of discharged sheets is performed at the stencil printing machine 40. FIG. 14(*a*) indicates a processing performed at the computer 43 and FIG. 14(*b*) indicates a processing at the stencil printing machine 40.

At the computer 43, printing information about the use of the network is set (SP50). The printing information includes the number of originals. In this case, the number of originals is the same meaning as the number of stencil sheets required for a printing operation. In addition, in the case that the image data is transmitted from the computer 43, the image data is set.

Then, the printing information is informed to the stencil printing machine 40 through the network 42 (SP51).

Upon receiving the data of the residual amount of discharged sheets from the stencil printing machine 40 (SP52), it is determined whether or not the content of this data shows an error of the residual amount of discharged sheets (SP53).

In the case that there occurs no error in the residual amount of discharged sheets (SP53-NO), an alarm processing about the residual amount of discharged sheets is completed. Then, the printing with the stencil printing machine 40 is started.

In turn, in the case that there is an error in the residual amount of discharged sheets (SP53-YES), an alarm of residual amount of discharged sheets is displayed at the display device (CRT or the like) of the computer 43.

Figure 15:
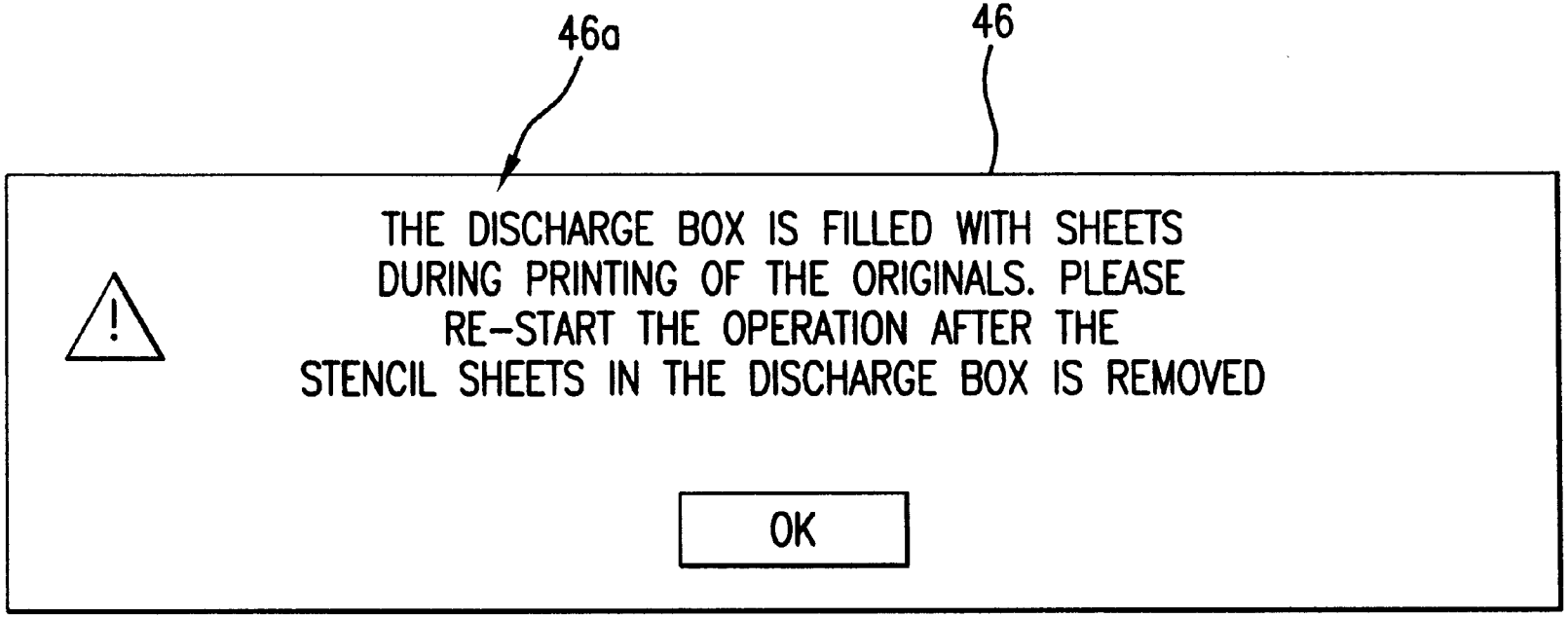
FIG. 15 is a view for showing a content of alarm for a discharge stencil displayed on a terminal screen. (No. 1)

FIG. 15 is a view for showing an example of display of an alarm.

As shown in this figure, "The discharge box is filled with sheets during printing of this original. Please re-start the operation after the stencil sheets in the discharge box are removed." is displayed in a row of letters 46*a* in the letter box 46.

In this way, the alarm is displayed at the computer 43 when it is judged that the stencil sheets P can not be stored in the discharge box 2.

Then, there will be described the content of processing at the stencil printing machine 40 in reference to FIG. 14(*b*).

At the stencil printing machine 40, the computer 43 may perform a setting of use of the network correspondingly in reference to the setting of the printing information under application of the network (SP56).

Then, the stencil printing machine 40 receives the printing information including the number of originals from the computer 43 (SP57).

Then, the residual amount of discharged sheets in the discharge box 2 is compared with the number of originals (SP58).

As a result of comparison, if the residual amount of discharged sheets is larger than or equal to the number of originals (SP59-YES), it is possible to store all the used stencil sheets P in the discharge box 2 through performing the present printing operation and it is judged that no error is found in the residual amount of discharged sheets.

Then, information saying "No error in the residual amount of discharged sheets" is set (SP60) and this information is transmitted to the computer 43 (SP62).

In turn, in the case that the number of originals is larger than the number of residual amount of the discharged sheets (SP59-NO), the used stencil sheets P can not be stored in the discharge box 2 in the midway part of the present printing operation and it is judged that an error of the residual amount of discharged sheets is present.

Then, information saying "Error is present in the residual amount of discharged sheets" is set (SP61) and this information is transmitted to the computer 43 (SP62).

Figure 16:
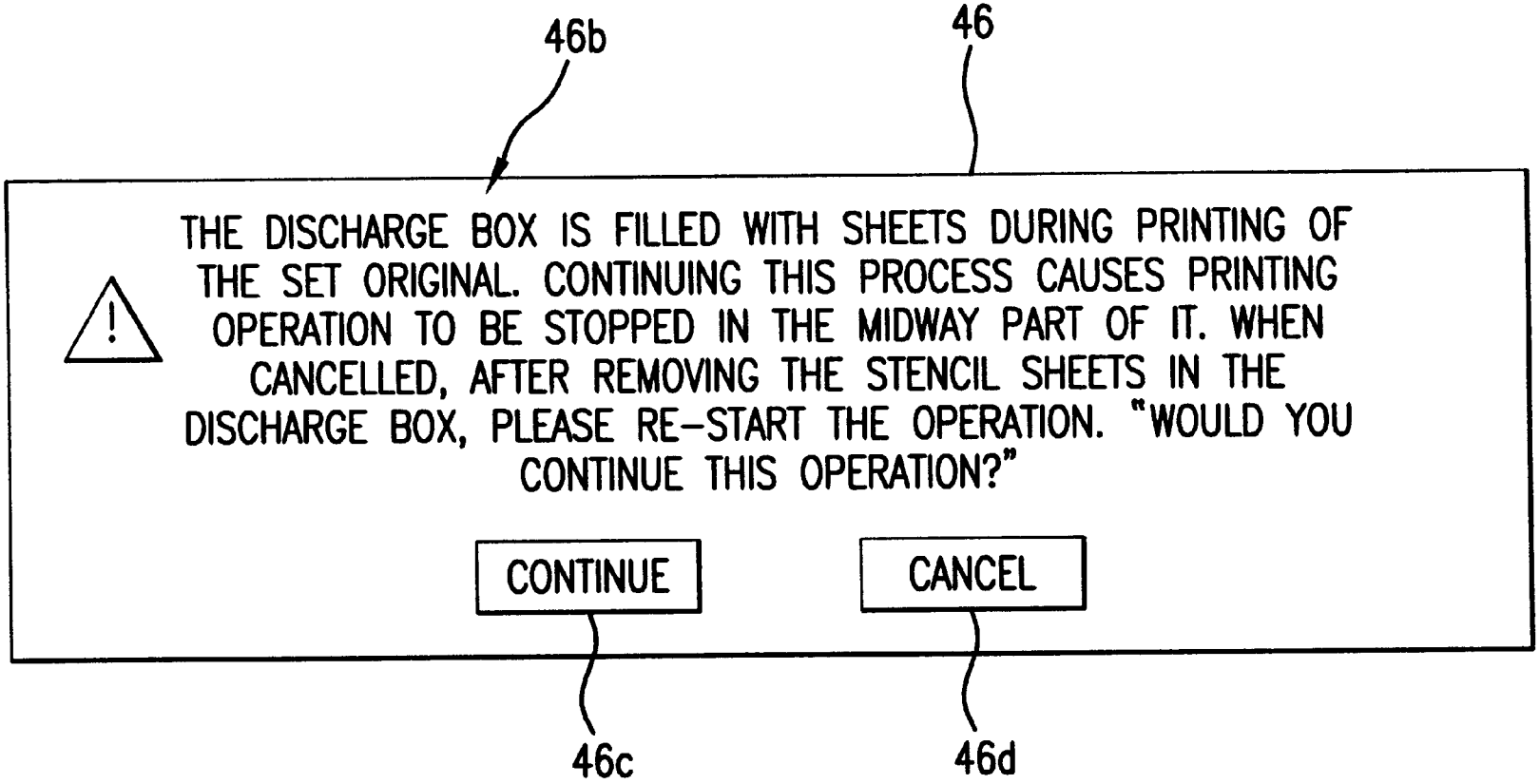
FIG. 16 is a view for showing a content of alarm for a discharge stencil displayed on a terminal screen. (No. 2)

FIG. 16 is a view for illustrating another example of alarm displayed at the computer 43. In the illustrated example, "The discharge box is filled with sheets during printing of the set original. Continuing this process causes printing operation to be stopped in the midway part of it. When cancelled, after removing the stencil sheets in the discharge box, please re-start the operation. Would you continue this operation?" in a row of letters 46*b* is displayed in the letter box 46. In regard to this display, either "continue" or "cancel" can be optionally selected on the computer 43 by the selection box 43*c*.

Seventh Preferred Embodiment

Figure 17A:
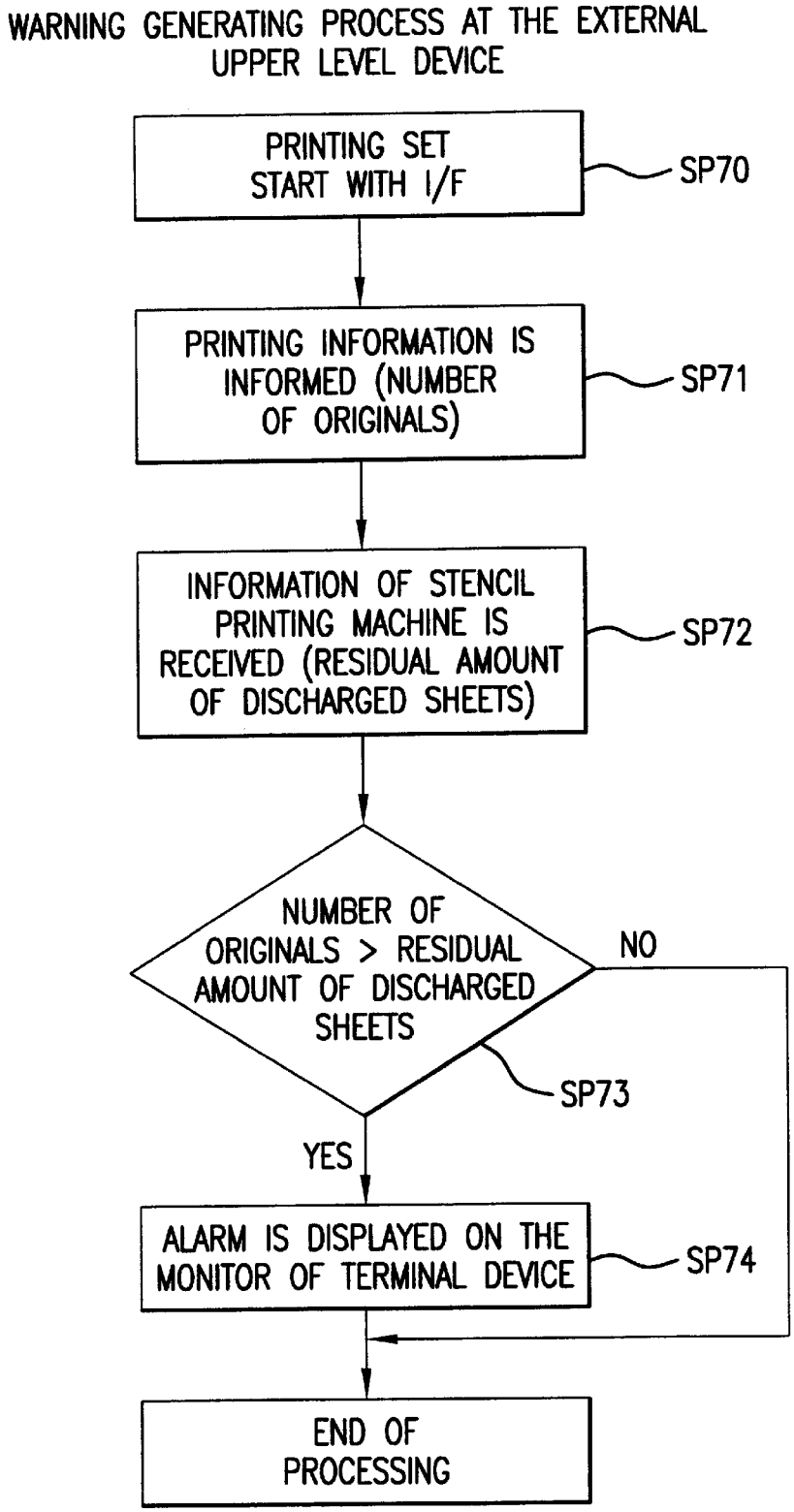
FIG. 17(*a*) is a flow chart for showing an alarm processing of a discharge stencil when a network printing of a seventh preferred embodiment of this invention is carried out.
Figure 17B:
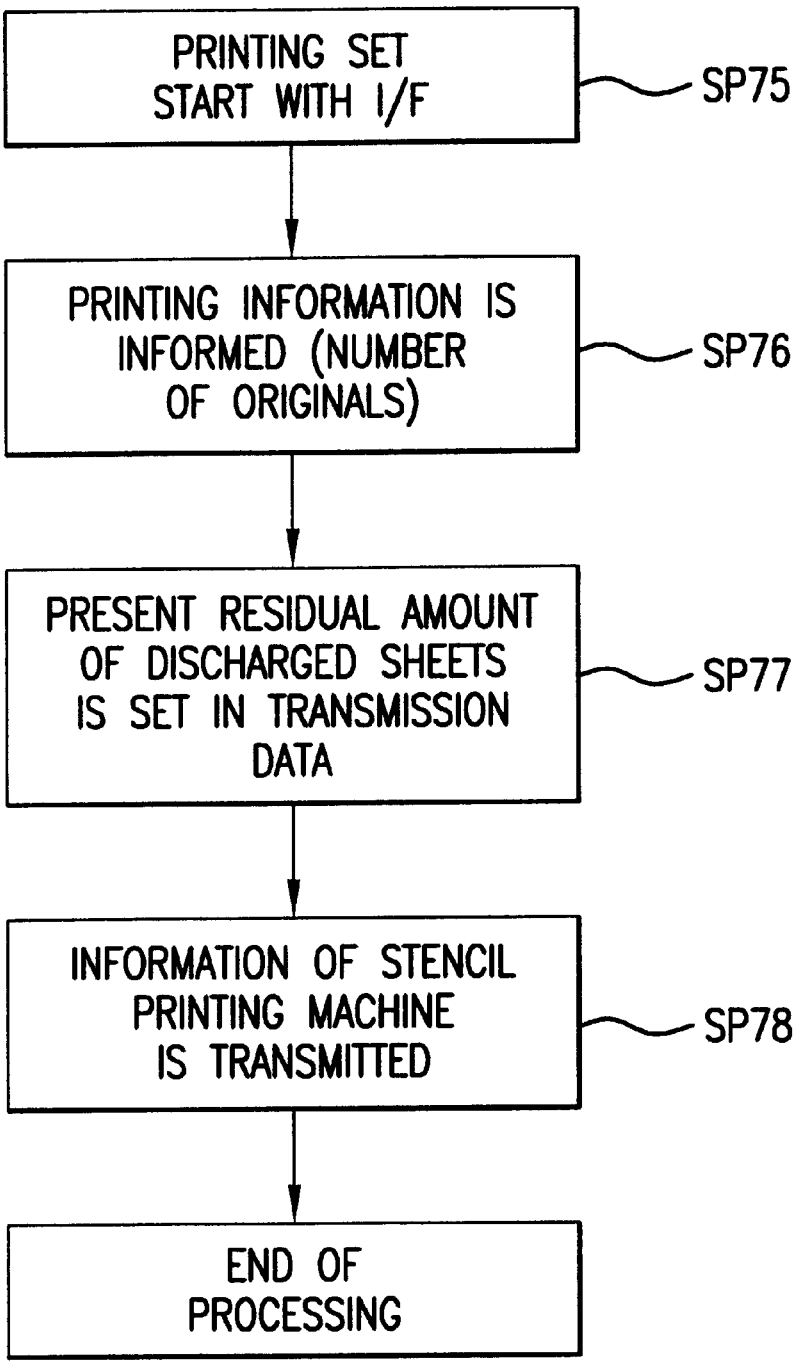

FIGS. 17(*a*) and 17(*b*) are flow charts for indicating the content of the processing in which the discriminating processing for the residual amount of discharged sheets is executed at the computer 43. FIG. 17(*a*) indicates a processing at the computer 43 and FIG. 17(*b*) indicates a processing at the stencil printing machine 40.

At the computer 43, printing information about the use of network is set (SP70). As the printing information, there is a number of originals (similar meaning to the number of discharged sheets). In addition, in the case that the image data is transmitted from the computer 43, the image data is set.

Then, the printing information is informed to the stencil printing machine 40 through the network 42 (SP71).

After the data about the residual amount of discharged sheets is received from the stencil printing machine 40 (SP72), the set number of originals is compared with the residual amount of the number of originals (SP73).

As a result of comparison, if the residual amount of discharged sheets is larger than or equal to the number of originals (SP73-NO), it is judged that it is possible to store all the used stencil sheets P in the discharge box 2 through performing the present printing operation and an alarm processing about the residual amount of discharged sheets is finished. Then, the printing by the stencil printing machine 40 is started.

In turn, as a result of comparison, if the number of originals is larger than the residual amount of discharged sheets (SP73-YES), it is judged that it is not possible to store all the used stencil sheets P in the discharge box 2 in the midway part of present printing operation, and an alarm processing about the residual amount of discharged sheets is executed (SP74).

When the alarm processing is carried out, the alarms described in FIGS. 15 and 16 are displayed on the display device at the computer 43.

Then, there will be described the content of processing at the stencil printing machine 40 in reference to FIG. 17(*b*).

At the stencil printing machine 40, the computer 43 correspondingly sets the use of network in response to the setting of the printing information used in the network (SP75).

Then, the stencil printing machine 40 receives the printing information including the number of originals from the computer 43 (SP76).

Then, the stencil discharge apparatus 1 may set information about the present residual amount of discharged sheets (SP77) and transmits this information toward the computer 43 (SP78).

In accordance with the aforesaid sixth and seventh preferred embodiments, since it is possible to know the sheet discharging state within the discharge box 2 at the stencil printing machine 40 when the stencil printing machine 40 is operated from the computers 43 through the network, it is possible to prevent that the discharge box 2 is filled with the sheet in the midway part of printing operation and then it is possible to perform a smooth printing operation through the network.

In accordance with the aforesaid sixth and seventh preferred embodiments, although the number of originals is automatically set as printing information handled by a printer driver, this invention is not limited to this state and this invention can be applied to the case in which a user may input and set the number of originals (the number of stencil sheets) through the key-board at the computer.

In accordance with the aforesaid second, sixth and seventh preferred embodiments, the method for sensing the residual amount is not limited to that of the first preferred embodiment, but other sensing methods may also be naturally employed. However, in accordance with the sensing method of the first preferred embodiment, its accuracy in operation is high and it is more convenient in operation.

In addition, it is of course apparent that even if the number of originals is smaller than the residual amount against a preparation for the case in which the method for sensing the residual amount is lack a little in its accuracy, the control is carried out for performing an alarm if the difference is lower than the predetermined value. In that case, since the sensing error can be accommodated, it has an effect that a lost of alarm when required is prevented.

In accordance with this invention, there is provided a configuration in which a storing amount of the stencil sheets within the discharge box is calculated in response to a moving amount of the compressing plate when the compressing means actually compresses the stencil sheets. With such an arrangement as above, it becomes possible to perform an accurate sensing of the actual stored state and further the stencil sheets can be stored up to a full level of the storing limit amount of the discharge box. In addition, concurrently, it is also possible to reduce the number of times of removing the stencil sheets from the discharge box and to perform an appropriate informing of the removing time. In addition, it is also possible to prevent an occurrence of jamming of the stencil sheets when the sheets are discharged due to erroneous sensing of a storing amount in the discharge box.

In addition, if the system is configured such that a residual amount of sheet which can be stored in the discharge box is attained or either the discharged amount of discharged sheets or the residual amount of discharged sheets is displayed through the display device, it is possible to perform a fast and accurate informing of the stored state in the discharge box and further improve a workability of a user.

In addition, in the case that all the stencil sheets to be planned to use can not be stored in the discharge box when the printed documents are made in a continuous manner, replacement of the discharge box can be informed to an external side. Thus, is possible to prevent an interruption of a continuous printing operation caused by a full filled state of the discharge box and further its workability can be improved.

In addition, since the residual amount of discharged sheets can be accurately held, if the surplus space is left in the residual amount in the discharge box, it is possible to restrict a consumption power of the device under an assumption that the moving amount of the compressing means is restricted.

Further, it is possible that the stencil sheet printing machine is connected to the network and a printing instruction is provided from the computers through the network. The control means in this configuration may transmit an alarm against the computer in the case that a storing amount of the stencil sheets after printing exceeds the storing limit amount of the discharge box in reference to the number of printing sheets inputted from the computer. Further, the control means transmits the residual amount of the discharged stencils at the very fast time of printing operation. With these means, the storing state in the discharge box at the computer can be understood, it becomes possible to prevent in advance that the sheets may not be discharged in the middle of the printing operation and the printing operation is stopped, resulting in that the network printing using the remote stencil sheet printing machine can be performed smoothly under an instruction attained from the remote computer.

What is claimed is:

1. A stencil discharge apparatus for a stencil printing machine having a discharge box for storing a predetermined amount of stencil sheets after being peeled off from a printing drum so as to discharge said stencil sheets, said stencil discharge apparatus comprising:

compressing means having a compressing plate for compressing the stencil sheets discharged into said discharge box by a movement of the compressing plate;

compressing pressure sensing means cooperating with the compressing means for sensing and outputting a predetermined compressing pressure of said compressing means;

moving amount sensing means connected to the compressing means, said moving amount sensing means sensing as a continuous value an amount of the movement of said compressing plate as the compressing plate is moved and outputting the amount of the movement when said compressing pressure sensing means senses the predetermined pressure; and control means electrically connected to the compressing pressure sensing means and the moving amount sensing means for calculating a storing amount of the stencil sheets in said discharge box on a basis of an amount of the movement sensed by said moving amount sensing means when said compressing pressure sensing means senses the predetermined pressure.

2. A stencil discharge apparatus for a stencil printing machine according to claim 1, wherein said compressing means includes a moving plate movable arranged inside the discharge box, a motor attached to the moving plate for actuating the compressing plate, and a resilient member disposed between the moving plate and the compressing plate so that when the motor is operated, the compressing plate is moved through the moving plate and the resilient member; said compressing pressure sensing means is disposed between the compressing plate and the moving plate; and the moving amount sensing means is a pulse encoder for sensing a rotation of the motor to measure an amount of movement of the moving plate as the amount of the movement of the compressing plate.

3. A stencil discharge apparatus for a stencil printing machine according to claim 1, further comprising a display device for displaying the storing amount of said stencil sheets or the residual amount which can be stored.

4. A stencil discharge apparatus for a stencil printing machine according to claim 1, wherein said control means alarms when the residual amount becomes less than a specified value on a basis of a storing limit amount of said discharge box and the amount of the movement of said compressing means.

5. A stencil discharge apparatus for a stencil printing machine according to claim 1, wherein said control means includes memory means for storing the storing amount of the stencil sheets within said discharge box; and said storing amount of the stencil sheet is stored in said memory means.

6. A stencil discharge apparatus for a stencil printing machine according to claim 5, wherein said control means reads out said storing amount of the stencil sheets stored in said memory means when said stencil sheets are discharged and causes a compressing operation of said compressing means not to be executed when said storing amount is more than a predetermined amount.

7. A stencil discharge apparatus for a stencil printing machine according to claim 1, wherein said control means causes the stencil sheets to be compressed with said compressing means when a power supply is turned on and calculates the storing amount of the stencil sheets within said discharge box on a basis of the amount of the movement sensed by said moving amount sensing means when said compressing pressure sensing means senses the predetermined pressure.

8. A stencil discharge apparatus for a stencil printing machine according to claim 1, wherein said control means includes an alarm operating when it is judged that the storing amount of the stencil sheets after printing exceeds a storing limit amount of said discharge box in case where an operating input for performing the printing requires discharging of a plurality of the stencil sheets.

9. A stencil discharge apparatus for a stencil printing machine according to claim 8, further comprising an operating panel for operating and inputting a number of the stencil sheets to be perforated.

10. A stencil discharge apparatus for a stencil printing machine according to claim 1, further comprising an external computer connected to said control means, said control means having an alarm operating when it is judged that the storing amount of the stencil sheets after printing exceeds a storing limit amount of said discharge box in case where printing is performed in reference to a number of the stencil sheets inputted from said external computer, said alarm being transmitted to the external computer.

11. A stencil discharge apparatus for a stencil printing machine according to claim 1, wherein said compressing means includes a moving plate movably arranged inside the discharge box, a motor attached to the moving plate, and a resilient member disposed between the moving plate and the compressing plate so that when the motor is operated, the compressing plate is moved through the moving plate and the resilient member; said compressing pressure sensing means is disposed between the compressing plate and the moving plate; and said moving amount sensing means is a distance measuring sensor for measuring an amount of movement of the moving plate as the amount of the movement of the compressing plate.

12. A stencil discharge apparatus for a stencil printing machine with a printing drum, comprising:

a discharge box for storing a predetermined amount of stencil sheets after being peeled off from the printing drum;

stencil sheet residual amount calculating means for calculating a residual amount of sheets which can be stored in said discharge box in reference to a storing limit amount of said discharge box and a storing amount of the stencil sheets already discharged into said discharge box;

means for inputting a number of originals to be printed, said number of originals being inputted prior to a situation where processing accompanied by discharging a plurality of the sheets is performed in a continuous manner; and control means electrically connected to the calculating means and the inputting means for comparing said number of originals inputted at the inputting means with said residual amount calculated at said calculated means, said control means having an alarm operating when said number of originals is more than the residual amount.

13. A stencil printing machine according to claim 12, further comprising:

an automatic document feeder on which a plurality of originals is mounted for feeding originals one by one; and an operating panel connected to the control means for inputting a number of originals set at said automatic document feeder; wherein said control means compares the number of originals inputted through said operating panel with the residual amount of discharge sheets in case of using said automatic document feeder.

14. A stencil discharge apparatus for a stencil printing machine having a discharge box for storing a predetermined amount of stencil sheets after being peeled off from a printing drum so as to discharge said stencil sheets, said stencil discharge apparatus comprising:

compressing means having a compressing plate for compressing the stencil sheets discharged into said discharge box by a movement of the compressing plate;

compressing pressure sensing means cooperating with the compressing means for sensing and outputting a compressing pressure of said compressing means;

moving amount sensing means connected to the compressing means, said moving amount sensing means sensing as a continuous value an amount of the movement of said compressing plate as the compressing plate is moved and outputting the amount of the movement when said compressing pressure sensing means senses the predetermined pressure; and control means electrically connected to the compressing pressure sensing means and the moving amount sensing means for calculating a residual amount of stencil sheets capable of being stored in said discharge box on a basis of a storing limit amount of the discharge box and the amount of the movement sensed by said moving amount sensing means when said compressing pressure sensing means senses a predetermined pressure upon completion of compression of the stencil sheet with the compressing means.

15. A stencil discharge apparatus for a stencil printing machine according to claim 14, further comprising a computer connected to the control means through a network, said control means transmitting the residual amount of sheets in the discharge box into said computer when printing is started.

* * * * *